US011405712B2

(12) United States Patent
Shinmen et al.

(10) Patent No.: US 11,405,712 B2
(45) Date of Patent: Aug. 2, 2022

(54) SOUND OUTPUT APPARATUS

(71) Applicant: Sony Corporation, Tokyo (JP)

(72) Inventors: Naoki Shinmen, Tokyo (JP); Go Igarashi, Tokyo (JP); Kohei Asada, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/630,920

(22) PCT Filed: May 1, 2018

(86) PCT No.: PCT/JP2018/017389
§ 371 (c)(1),
(2) Date: Jan. 14, 2020

(87) PCT Pub. No.: WO2019/017036
PCT Pub. Date: Jan. 24, 2019

(65) Prior Publication Data

US 2020/0137476 A1 Apr. 30, 2020

(30) Foreign Application Priority Data

Jul. 21, 2017 (JP) ..... JP2017-142273

(51) Int. Cl.
*H04R 1/10* (2006.01)
*H04R 1/26* (2006.01)
(Continued)

(52) U.S. Cl.
CPC ..... *H04R 1/1016* (2013.01); *H04R 1/105* (2013.01); *H04R 1/1066* (2013.01); *H04R 1/26* (2013.01);
(Continued)

(58) Field of Classification Search
CPC ..... H04R 1/10; H04R 1/1016; H04R 1/1075; H04R 1/20; H04R 1/22; H04R 1/24;
(Continued)

(56) References Cited

U.S. PATENT DOCUMENTS 5,677,964 A * 10/1997 Sun ..... H04R 1/345 381/189
6,307,943 B1 * 10/2001 Yamagishi ..... H04R 1/2857 381/312
(Continued)

FOREIGN PATENT DOCUMENTS

EP 2595408 A1 5/2013
EP 3086566 A1 10/2016
(Continued)

OTHER PUBLICATIONS

UNSW, Acoustic Impedance, Intensity and Power, https://web.archive.org/web/20110112062529/https://www.animations.physics.unsw.edu.au/jw/sound-impedance-intensity.htm (archived by the WayBackMachine on Jan. 12, 2011) (Year: 2011).*
(Continued)

*Primary Examiner* — Walter F Briney, III
(74) *Attorney, Agent, or Firm* — Wolf, Greenfield & Sacks, P.C.

(57) ABSTRACT

Provided is a sound output apparatus that is used by being worn in the vicinity of the ear of a listener and is capable of outputting sound over a wide frequency band.
The sound output apparatus includes: a first sound generation unit configured to generate a low frequency band; a sound guiding unit with a hollow structure, having one end coupled to the first sound generation unit, and the other end as a sound emission unit including an open end; and a second sound generation unit that is disposed at a place closer to the sound emission unit than the first sound generation unit and generates a high frequency band. It is
(Continued)

preferable that the sound guiding unit have a joint unit that takes in the sound from the second sound generation unit and a section from the joint unit to the sound emission unit have a low impedance.

11 Claims, 24 Drawing Sheets

(51) Int. Cl.
*H04R 3/14* (2006.01)
*H04R 23/02* (2006.01)

(52) U.S. Cl.
CPC ..... *H04R 3/14* (2013.01); *H04R 23/02* (2013.01); *H04R 2225/00* (2013.01)

(58) Field of Classification Search
CPC ..... H04R 1/26; H04R 1/28; H04R 1/2803; H04R 1/30; H04R 3/12; H04R 5/033; H04R 5/0335; H04R 25/00; H04R 25/02; H04R 25/48; H04R 25/60; H04R 25/604; H04R 25/65; H04R 25/656; H04R 2201/00; H04R 2201/10; H04R 2201/103; H04R 2201/405; H04R 2225/022; H04R 2225/00; H04R 2225/021; H04R 2225/55; H04R 2460/00; H04R 2460/09
See application file for complete search history.

(56) References Cited

U.S. PATENT DOCUMENTS

| | | | | |
|---|---|---|---|---|
| 9,860,645 | B1 * | 1/2018 | Tsui | H04R 1/1016 |
| 2006/0133631 | A1 * | 6/2006 | Harvey | H04R 1/1016 381/312 |
| 2007/0291971 | A1 * | 12/2007 | Halteren | H04R 25/48 381/322 |
| 2011/0058702 | A1 * | 3/2011 | Saggio, Jr. | H04R 1/1016 381/380 |
| 2011/0182455 | A1 * | 7/2011 | Wickstrom | H04R 1/10 381/353 |
| 2012/0057739 | A1 * | 3/2012 | Smith | H04R 1/1008 381/379 |
| 2012/0237068 | A1 | 9/2012 | Fretz | |
| 2013/0251161 | A1 * | 9/2013 | Lott | H04R 1/1058 381/58 |
| 2013/0266170 | A1 | 10/2013 | Yamagishi | |
| 2013/0343584 | A1 | 12/2013 | Bennett et al. | |
| 2014/0119586 | A1 * | 5/2014 | Mortensen | H04R 25/656 381/330 |
| 2015/0117694 | A1 * | 4/2015 | Depallens | H04R 25/604 381/380 |
| 2016/0316289 | A1 | 10/2016 | Huang | |
| 2017/0230741 | A1 * | 8/2017 | Matsuo | H04R 5/033 |
| 2018/0247646 | A1 * | 8/2018 | Meacham | G10L 15/063 |
| 2018/0288513 | A1 * | 10/2018 | Ball | H04R 1/1075 |

FOREIGN PATENT DOCUMENTS

| | | | |
|---|---|---|---|
| EP | 1 871 141 | A2 | 4/2017 |
| JP | S6291655 | A | 4/1987 |
| JP | 63-200988 | | 12/1988 |
| JP | H03-117999 | A | 5/1991 |
| JP | 3-162099 | A | 7/1991 |
| JP | 2002-257581 | | 9/2002 |
| JP | 2013-062561 | A | 4/2013 |
| JP | 2013-143735 | A | 7/2013 |
| JP | 5498515 | | 5/2014 |
| JP | 3199744 | U | 8/2015 |
| WO | 2016/067700 | A1 | 5/2016 |

OTHER PUBLICATIONS

International Written Opinion dated Jun. 19, 2018 in connection with International Application No. PCT/JP2018/017389, and English translation thereof.
International Preliminary Report on Patentability dated Jan. 30, 20200 in connection with International Application No. PCT/JP2018/017389, and English translation thereof.
Extended European Search Report dated Jul. 20, 2020 in connection with European Application No. 18835972.3.
International Search Report and English translation thereof dated Jun. 19, 2018 in connection with International Application No. PCT/JP2018/017389.
Japanese Office Action dated Oct. 22, 2021 in connection with Japanese Application No. 2019-530887, and English translation thereof.

* cited by examiner

SOUND OUTPUT APPARATUS

CROSS-REFERENCE TO RELATED APPLICATIONS

This application claims the benefit under 35 U.S.C. § 371 as a U.S. National Stage Entry of International Application No. PCT/JP2018/017389, filed in the Japanese Patent Office as a Receiving Office on May 1, 2018, which claims priority to Japanese Patent Application Number JP2017-142273, filed in the Japanese Patent Office on Jul. 21, 2017, each of which is hereby incorporated by reference in its entirety.

TECHNICAL FIELD

The technology disclosed in this specification relates to a sound output apparatus used by being worn in the vicinity of the ear of a listener.

BACKGROUND ART

Along with the emergence of high-resolution audio and the like in recent years, a wide band of reproducible frequency has been demanded for devices that reproduce content related to sound such as music.

Small wearable sound reproduction apparatuses, such as earphones, have a limited low-frequency reproduction capability. Thus, in order to enhance the sensitivity to low-frequency reproduction, it is necessary to mount a large driver. However, there is a problem that it is difficult to arrange the large driver near the entrance of the ear canal of a listener. For example, in a case of an earphone that fits into the ear concha, it is difficult to arrange the large driver.

For example, for a sound-isolating earphone that is used in a state where the ear hole is being sealed, an earphone has been proposed in which a first sounding body responsible for a high-frequency band, a second sounding body responsible for a mid-frequency band, and a third sounding body responsible for a low-frequency band are built in a housing, and the attenuation of a sound in the high-frequency band is suppressed to prevent the deterioration in the sound quality of the reproduced sound (e.g., see Patent Document 1).

Meanwhile, an ear-hole open earphone has a feature that a listener can hear not only the sound emitted by the apparatus but also the ambient sound. For example, an ear-hole open sound output apparatus has been proposed in which a sound generation unit is arranged on the back of the ear of a listener (e.g., see Patent Document 2). Since this type of earphone has a structure in which the main body of the apparatus including a driver is arranged on the back side of the auricle, it is believed to be possible to realize natural hearing while suppressing the influence on the ambient sound heard by a listener.

Furthermore, in a case of an earphone in which a driver is arranged behind the ear, the restriction on the arrangement of a large driver has a relatively high degree of freedom, and the sensitivity to the low-frequency band can be enhanced. However, a sound guiding duct that extends from the rear of the ear to the vicinity of the ear hole tends to be long, and there is a concern that the attenuation of the high-frequency band in the duct will increase. Furthermore, a sharp dip may occur in part of a frequency band in some cases due to the acoustic resonance of the sound guiding duct. Note that the "dip" referred herein is a depression where the sound pressure obtained at a specific frequency is decreased due to the frequency characteristics.

CITATION LIST

Patent Document

Patent Document 1: Japanese Patent No. 5498515
Patent Document 2: WO2016/067700

SUMMARY OF THE INVENTION

Problems to be Solved by the Invention

An object of the technology disclosed in this specification is to provide a sound output apparatus that is used by being worn in the vicinity of the ear of a listener and is capable of outputting sound over a wide frequency band.

Solutions to Problems

The technology disclosed in this specification is a sound output apparatus including:

a first sound generation unit configured to generate a low-frequency band;

a sound guiding unit with a hollow structure, having one end coupled to the first sound generation unit, and the other end as a sound emission unit including an open end; and a second sound generation unit that is disposed at a place closer to the sound emission unit than the first sound generation unit and generates a high-frequency band.

For example, the first sound generation unit is disposed on the back of the ear of a listener, the sound emission unit is worn in the vicinity of the entrance of the ear canal of the listener, and the second sound generation unit is disposed at the cavum conchae of the listener. Furthermore, the length of the sound guiding unit from the sound emission unit to the first sound generation unit is 60 mm to 80 mm, and the length from the sound emission unit to the second sound generation unit is 20 mm or less.

Furthermore, the sound guiding unit has a joint unit that is located before the sound emission unit and takes in the sound from the second sound generation unit. Then, the section from the sound emission unit to the joint unit is constituted to have a lower impedance than the section from the joint unit to the first sound generation unit.

Furthermore, the sound output apparatus may further have a holding unit that holds the sound guiding unit in the vicinity of the sound emission unit. The holding unit is constituted to be inserted into the cavum conchae of the listener and locked to the intertragic notch.

Furthermore, the sound output apparatus may further include a third sound generation unit that generates a mid-frequency band. The third sound generation unit is disposed at a place closer to the sound emission unit than the first sound generation unit and farther from the sound emission unit than the second sound generation unit.

Furthermore, the sound output apparatus may further include a division unit that divides the frequency bands of signals inputted into the respective sound generation units in accordance with responsible frequency bands of the respective sound generation units.

Effects of the Invention

According to the technology disclosed in this specification, it is possible to provide a sound output apparatus that is used by being worn in the vicinity of the ear of a listener and is capable of outputting sound over a wide frequency band.

Note that the effects described in this specification are merely examples, and the effects of the present invention are not limited thereto. Furthermore, in addition to the above effects, the present invention may further exert additional effects.

Still other objects, features and advantages of the technology disclosed in this specification will become apparent from a more detailed description based on the embodiments described later and the accompanying drawings.

MODE FOR CARRYING OUT THE INVENTION

Hereinafter, the embodiments of the technology disclosed in this specification will be described in detail with reference to the drawings.

Figure 1:
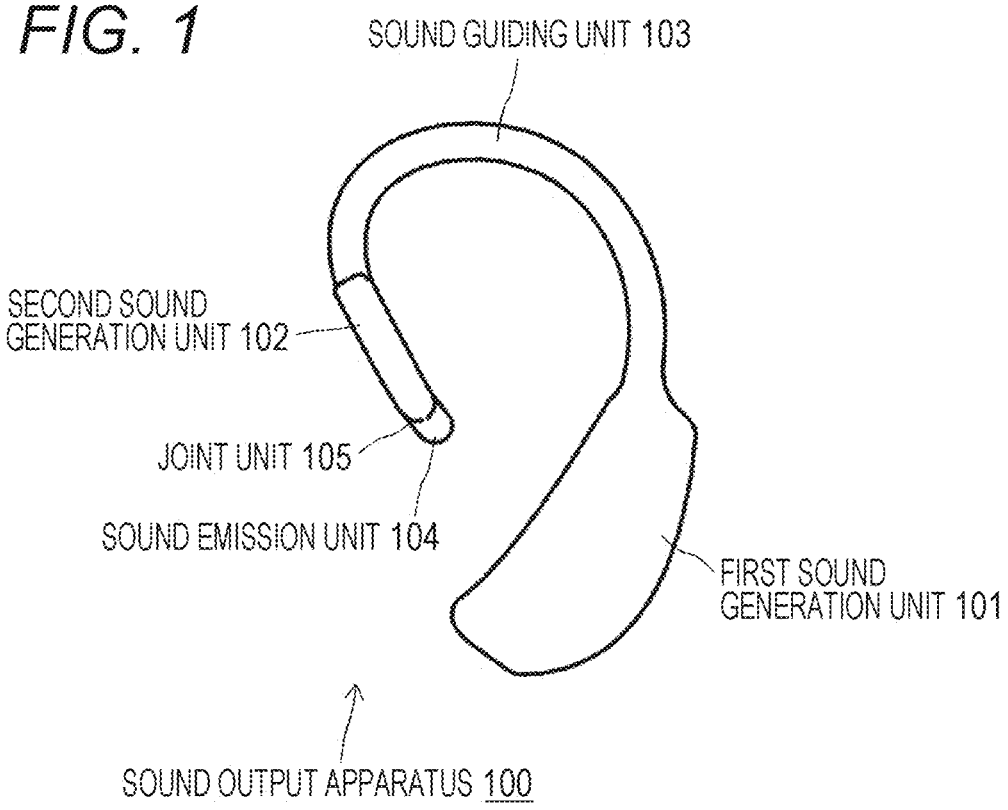
FIG. 1 is a view showing an exterior configuration example of a sound output apparatus 100.
Figure 2:
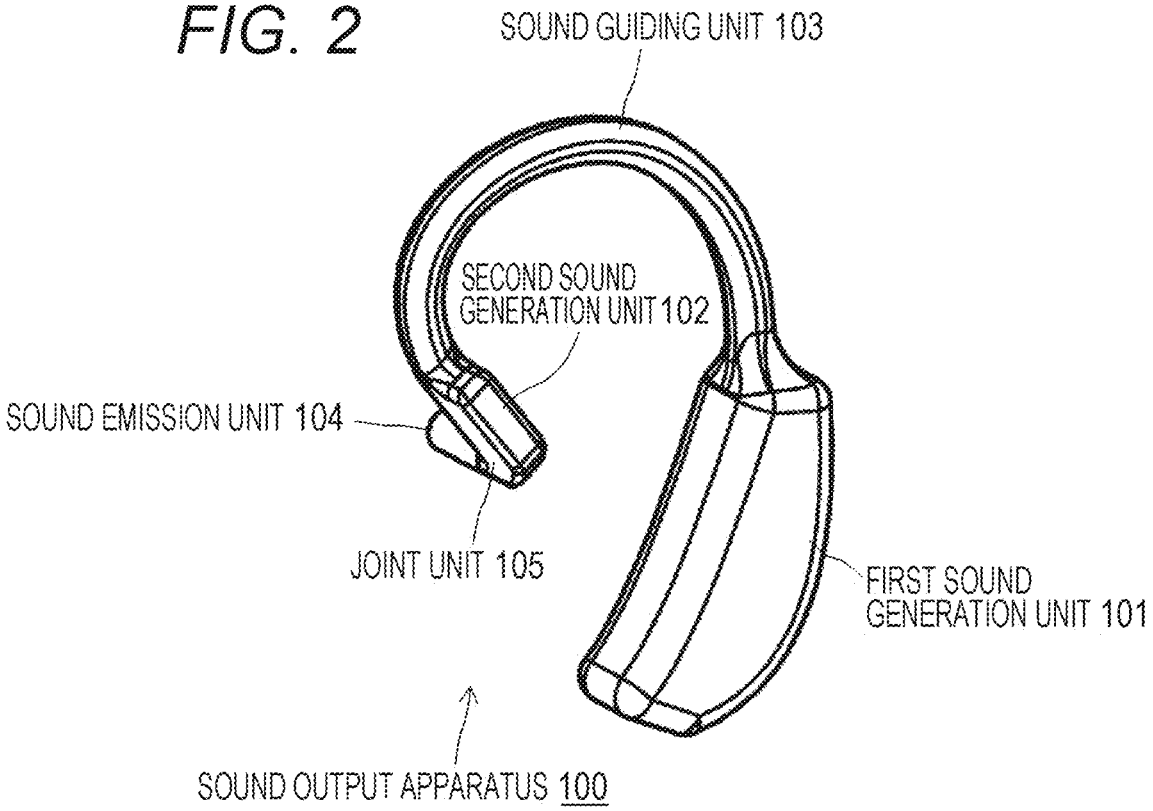
FIG. 2 is a view showing an exterior configuration example of the sound output apparatus 100.
Figure 3:
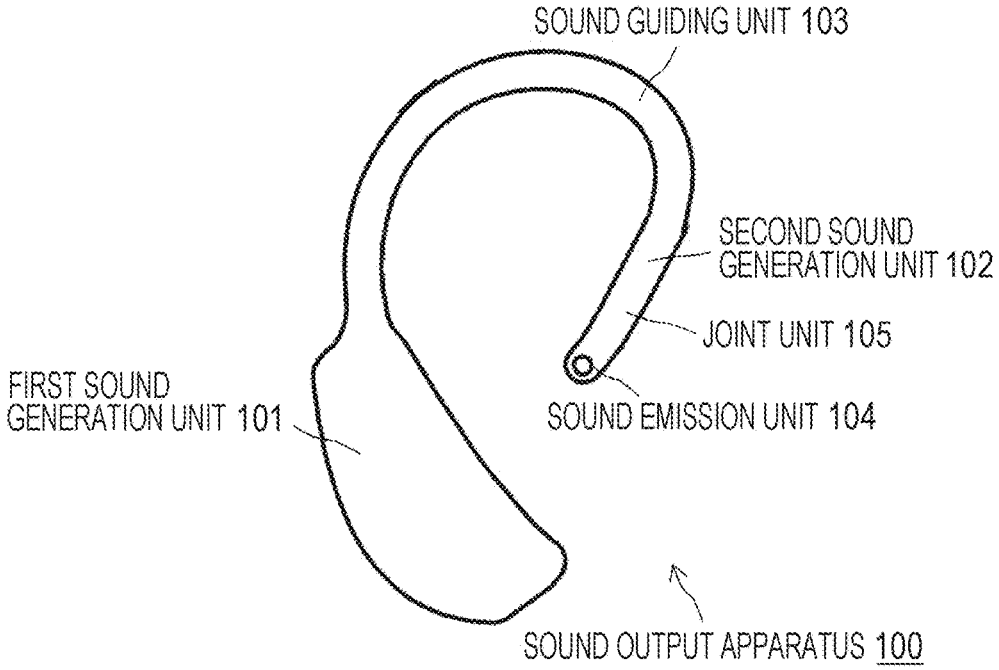
FIG. 3 is a view showing an exterior configuration example of the sound output apparatus 100.

FIGS. 1 to 3 show exterior configuration examples of a sound output apparatus 100 according to one embodiment of the technology disclosed in this specification. As will be described later, the sound output apparatus 100 is basically used by being worn on the auricle of a listener who is a listener.

The illustrated sound output apparatus 100 includes a first sound generation unit 101, a second sound generation unit 102 and a sound guiding unit 103. The first sound generation unit 101 mainly generates a low-frequency sound, and the second sound generation unit 102 mainly generates a high-frequency sound. The sound guiding unit 103 propagates the respective acoustic signals outputted from the first sound generation unit 101 and the second sound generation unit 102 to the vicinity of the entrance of the ear canal of the listener. The sound guiding unit 103 includes a hollow tubing material. FIG. 1 is a plan view substantially parallel to the axis of this tube, and FIG. 2 is a perspective view of the sound output apparatus 100 viewed from a direction inclined with respect to the normal line of the plane including the axis of this tube. Furthermore, FIG. 3 is a plan view showing the rear side of the sound output apparatus 100 in FIG. 1. Note that each drawing shows a configuration example of the sound output apparatus 100 for the left ear, but it should be appreciated that a sound output apparatus for the right ear has a similar configuration in a mirror-reversed manner.

The sound guiding unit 103 has one end coupled to the first sound generation unit 101 and the other end being an open end and forming a sound emission unit 104. Therefore, an acoustic signal generated from the first sound generation unit 101 is taken in from the one end of the sound guiding unit 103, propagates through the tube and advances toward the sound emission unit 104.

Furthermore, the second sound generation unit 102 is disposed in the course of the sound guiding unit 103, that is, at a place closer to the sound emission unit 104 than the first sound generation unit 101. Then, the sound guiding unit 103 includes a joint unit 105 that takes in the acoustic signal outputted from the second sound generation unit 102 to cause the acoustic signal to join the acoustic signal outputted from the first sound generation unit 101. The respective acoustic signals of the sounds in the low-frequency and high-frequency bands generated from the first sound generation unit 101 and the second sound generation unit 102 are synthesized at the joint unit 105 and then emitted to the outside by the sound emission unit 104. Therefore, the sound output apparatus 100 as a whole can reproduce sound having a desired sound pressure over a wide frequency band from a low-frequency band to a high-frequency band.

Here, in the sound guiding unit 103, the section from the first sound generation unit 101 to the joint unit 105 is constituted to have a high impedance, and the section from the joint unit 105 to the sound emission unit 104 is constituted to have a low impedance. Thus, it is possible to suppress the acoustic signal, which is generated from the second sound generation unit 102, from flowing back to the first sound generation unit 101 from the joint unit 105. However, the details of the structure in the vicinity of the joint unit 105 will be described later.

The sound guiding unit 103 is bent to a substantially right angle before the sound emission unit 104 and forms an L-shape. In the examples shown in FIGS. 1 and 2, the sound guiding unit 103 is bent in the vicinity of the joint unit 105. As will be described later, when the sound output apparatus 100 is attached to the ear of a listener, the bent portion of the sound guiding unit 103 reaches the entrance of the ear canal, and the bent sound emission unit 104 can be directed toward the entrance of the ear canal.

The second sound generation unit 102 that generates a high-frequency sound can be constituted to be relatively small and does not block the ear hole even if the second sound generation unit 102 is arranged in the cavum conchae (or in the vicinity of the entrance of the ear canal). On the other hand, the first sound generation unit 101 that generates a low-frequency sound is constituted to be relatively large. Thus, the first sound generation unit 101 blocks the ear hole when the first sound generation unit 101 is arranged in the cavum conchae. Furthermore, the attenuation is greater in a higher frequency band. Thus, if the second sound generation unit 102 is arranged away from the ear hole, the listener will listen to a sound with more low frequency and less high frequency. In the present embodiment, the second sound generation unit 102 is disposed near the sound emission unit 104, and the first sound generation unit 101 is disposed far from the sound emission unit 104. Thus, the ear hole of the listener can be open as well as the listener can listen to good sound with a balanced sound pressure in the low frequency band and high frequency band.

Note that the peripheries of the first sound generation unit 101 and the second sound generation unit 102 are covered with resin, such as plastic, or metal, wood, or the like, but there may be a portion that is partially exposed.

Figure 4:
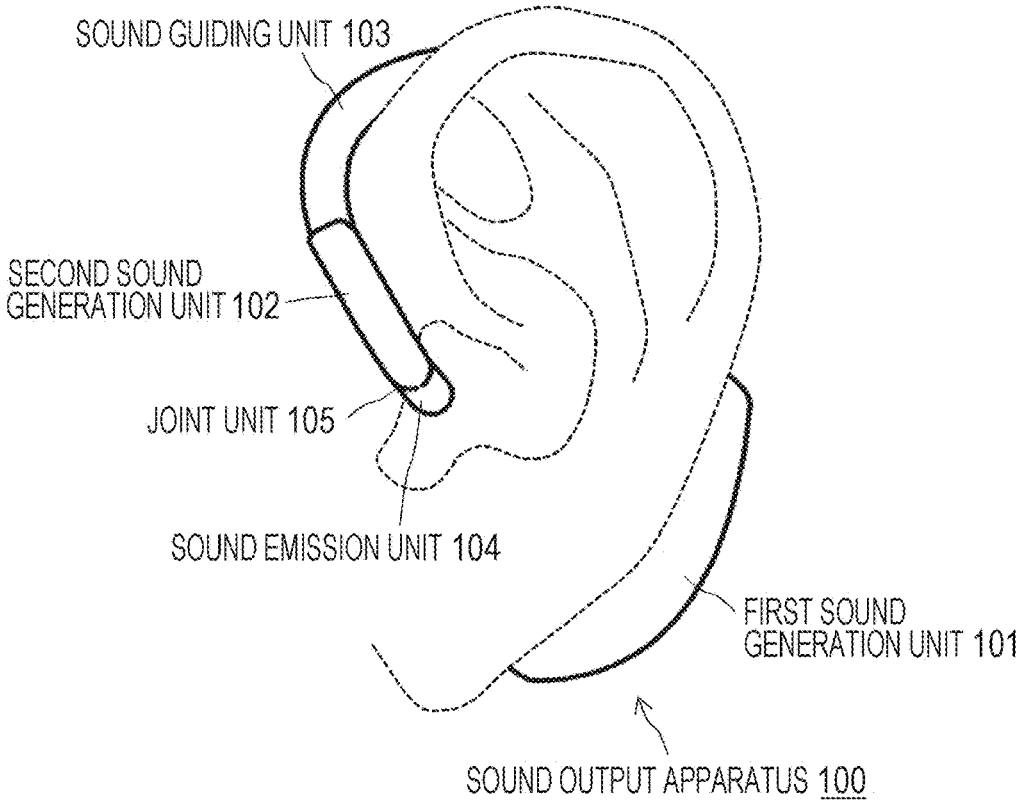
FIG. 4 is a view showing how the sound output apparatus 100 is worn on the ear of a listener.

FIG. 4 shows how the sound output apparatus 100 is worn on the ear of a listener. The sound guiding unit 103 includes a substantially U-shaped elastic body. Accordingly, the sound output apparatus 100 can be worn on the ear of the listener by hooking the sound guiding unit 103 onto the upper side of the helix of the listener. As shown in the drawing, the first sound generation unit 101 is arranged on the back side of the auricle, and the sound emitted from the first sound generation unit 101 is propagated to the front side of the auricle by the sound guiding unit 103.

The sound guiding unit 103 is hooked on the helix with the U-shaped opening slightly expanded. For example, the auricle is sandwiched by utilizing the resilience of the sound guiding unit 103 to return to the original U-shape so that the sound output apparatus 100 is fixed to the ear of the listener. As a matter of course, the main body of the sound output apparatus 100 can also be worn on the ear of the listener only by the action of hooking the U-shaped opening on helix, without utilizing the resilience of the sound guiding unit 103. Furthermore, the sound guiding unit 103 follows the crus of helix and enters the cavum conchae. Then, the sound guiding unit 103 is bent to a substantially right angle in the vicinity of the joint unit 105, the sound emission unit 104 is directed toward the entrance of the ear canal, and the outer wall of the sound guiding unit 103 in the vicinity of the sound emission unit 104 is engaged with the entrance of the ear canal of the listener.

In a state where the sound output apparatus 100 is worn on the ear of the listener as shown in FIG. 4, the sound emission unit 104 is directed toward the deep side of the ear canal so that the sound propagated by the sound guiding unit 103 can be suitably emitted toward the eardrum of the listener.

As can be seen from FIG. 4, the second sound generation unit 102 is disposed near the entrance of the ear canal, and the first sound generation unit 101 is disposed far from the entrance of the ear canal. Since the second sound generation unit 102 that generates a sound in a second frequency band, which is a high frequency band, is disposed near the entrance of the ear canal, the high-frequency acoustic signal can be delivered to the ear hole without much attenuation. The second sound generation unit 102 that generates a sound in the second frequency band, which is a high frequency band, can be constituted to be relatively small. Thus, the second sound generation unit 102 does not block the ear hole even if the second sound generation unit 102 is disposed in the cavum conchae (or in the vicinity of the entrance of the ear canal). That is, the open state of the ear hole is not hindered.

Furthermore, as can be seen from FIG. 4, the first sound generation unit 101 that generates a low-frequency acoustic signal and is relatively large is difficult to be arranged in the cavum conchae and is arranged at a place away from the ear hole, such as the back of the auricle. The first sound generation unit 101 is in contact with the shaped surface of the rear of the ear. Thus, by shaping the first sound generation unit 101 into a crescent casing that suits the shaped surface of the rear of the ear as shown in FIGS. 1 and 2, the first sound generation unit 101 can easily fit the surface of the rear of the ear.

Since the first sound generation unit 101 is arranged at a place away from the entrance of the ear canal, the ear hole is not blocked and can be kept open even in a state where the sound output apparatus 100 is worn on the ear of the listener. Furthermore, the acoustic signal emitted from the first sound generation unit 101 has a low frequency so that the attenuation is small. Thus, the acoustic signal can be delivered to the entrance of the ear canal with slight attenuation even if the acoustic signal is propagated a relatively long distance from the rear of the ear by the sound guiding unit 103.

In short, the sound output apparatus 100 according to the present embodiment does not block the ear hole when the sound output apparatus 100 is worn on the ear of the listener, and thus can be said to be an "ear-hole open type." The sound output apparatus 100 is equipped with a plurality of sound generation units, which includes the first sound generation unit 101 that mainly generates a low frequency band side and the second sound generation unit 102 that mainly generates a high frequency band side, and can realize sound over a wide frequency band by synthesizing the sounds generated from the respective sound generation units. Furthermore, the plurality of sound generation units is arranged at a plurality of places rather than a single place (more specifically, a sound generation unit large in size is arranged away from the ear hole), and thus the feature of an ear-hole open type can be obtained.

Therefore, the features of the ear-hole open sound output apparatus 100 are that the sound output apparatus 100 can realize listening characteristics of the ambient sound also in a wearing state, which are equivalent to those in a non-wearing state, and output acoustic information at the same time and that the ear holes of the listener appear not to be blocked to the people around even in the wearing state. By taking advantage of such features, the sound output apparatus 100 can be applied to the fields of various sports (during play, remote coaching and the like) performed outdoors and indoors, such as walking, jogging, cycling, climbing, skiing, and snowboarding, the fields of communication or presentation which requires listening to the ambient sound and presenting the audio information at the same time (e.g., supplementary information at the time of watching a play, audio information presentation in museums, bird watching (cry listening) and the like), driving or navigation, security guards, newscasters, and the like.

Figure 5:
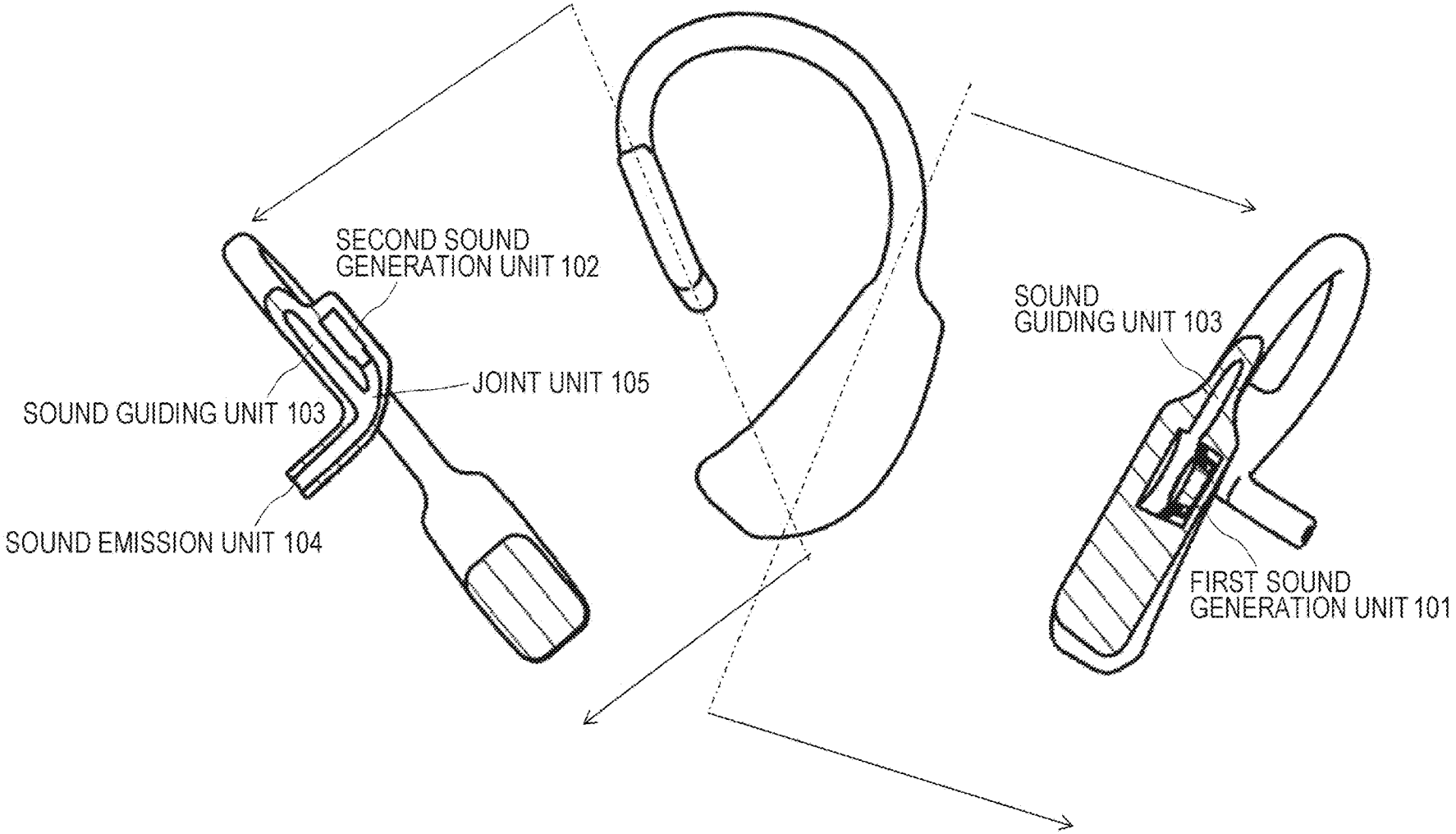
FIG. 5 is a view showing cross-sectional configuration examples of the sound output apparatus 100.

FIG. 5 shows cross-sectional configuration examples of the sound output apparatus 100 in the vicinity of the first sound generation unit 101 as well as in the vicinity of the second sound generation unit 102. Furthermore, FIG. 6 shows an enlarged cross-section in the vicinity of the first sound generation unit 101, and FIG. 7 shows an enlarged cross-section in the vicinity of the second sound generation unit 102.

Figure 6:
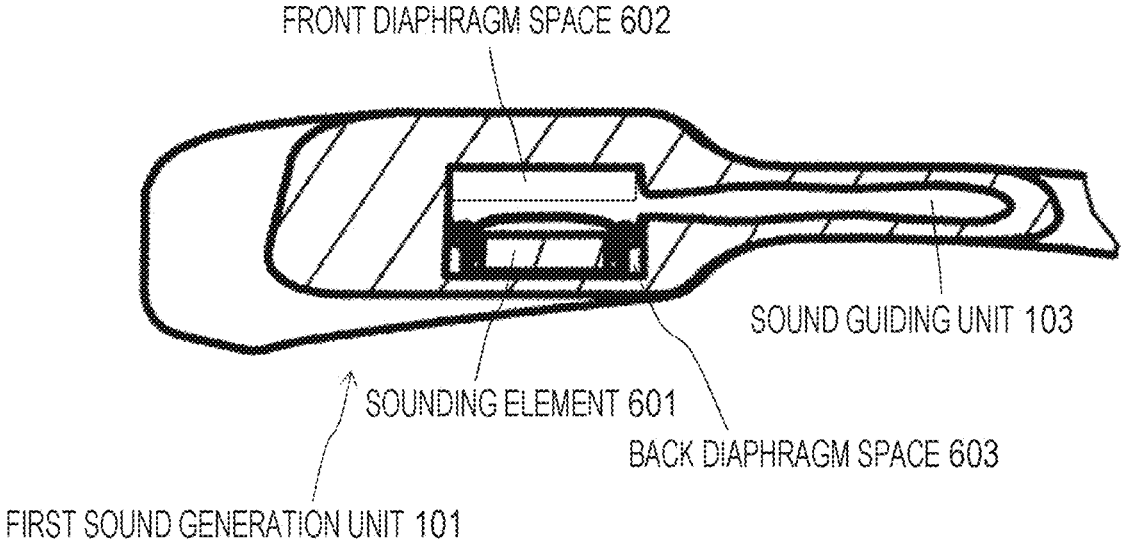
FIG. 6 is an enlarged view showing a cross-section in the vicinity of the first sound generation unit 101.
Figure 7:
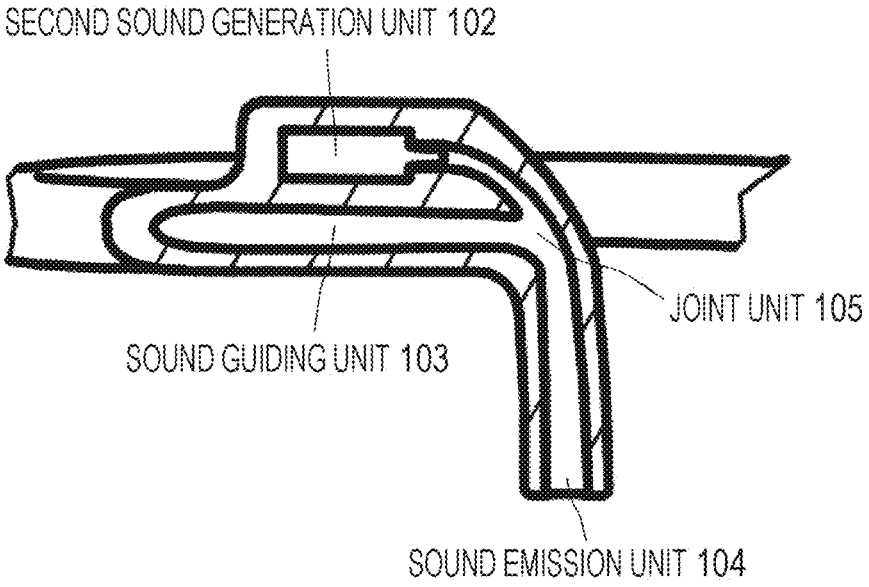
FIG. 7 is an enlarged view showing a cross-section in the vicinity of the second sound generation unit 102.

The first sound generation unit 101 shown in FIG. 6 utilizes a sounding element 601 such as a speaker that produces a change in sound pressure. The inside of the first sound generation unit 101 is partitioned into a front diaphragm space 602 and a back diaphragm space 603 by a diaphragm of the sounding element 601. Then, when the diaphragm of the speaker moves back and forth, sound is generated due to changes in atmospheric pressure in the front diaphragm space and the back diaphragm space. Note that one or more exhaust holes may be provided just in case a high atmospheric pressure is generated inside the first sound generation unit 101.

As long as the first sound generation unit 101 has a size that fits in the housing, the first sound generation unit 101 may be any one of a balanced armature type, a piezoelectric type, or an electrostatic type besides a dynamic type speaker, or a combination of two or more types.

In the present embodiment, suppose that the length of the sound guiding unit 103 from the first sound generation unit 101 to the sound emission unit 104 is 60 mm to 80 mm. Before the sound generated by the first sound generation unit 101 is emitted from the sound emission unit 104, the high frequency band is attenuated due to the influence of the tube of the sound guiding unit 103. Furthermore, since resonance occurs due to the tube of the sound guiding unit 103, a specific frequency (audible band) has a dip where the sound pressure decreases depending on the length of the tube. Thus, not the sound itself generated by the first sound generation unit 101, but a sound having high frequency band attenuation and a dip at a specific frequency as described above is delivered to the ear of the listener.

Note that the first sound generation unit 101 is disposed at the rear of the ear as shown in FIG. 4, the restrictions on the size of the housing are relatively mild. In the configuration examples shown in FIGS. 5 and 6, the sounding element occupies only part of the housing of the first sound generation unit 101, and there is a room in space. Other circuit parts may be accommodated in an extra space inside the housing for effective utilization.

For example, a communication interface that sends and receives audio and other signals to and from an external apparatus (such as a sound source) by wire or wirelessly, and other circuit parts may be disposed in an empty space inside the first sound generation unit 101. Furthermore, a position information sensor such as a global positioning system (GPS), a three-dimensional acceleration/angular velocity sensor such as an inertial measurement unit (IMU), and a gyro sensor can be mounted in the first sound generation unit 101 to be utilized for audio signal processing and information presentation according to the situation of the listener. Furthermore, in order to take advantage of the feature that the sound output apparatus 100 is worn on a human body, a biosensor may be disposed in an empty space inside the first sound generation unit 101. Furthermore, a battery that supplies power to a circuit disposed in the sound output apparatus 100, a power management circuit, and the like may be disposed in the first sound generation unit 101 (a rechargeable battery such as a lithium-ion battery may be used for the battery). Moreover, in a case where the other circuit parts exemplified above are arranged in a casing outside the sound output apparatus 100, a communication interface, which sends and receives signals and data by wire or wirelessly between the sound output apparatus 100 and the casing outside the sound output apparatus 100, may be disposed in an empty space.

The second sound generation unit 102 shown in FIG. 7 also utilizes a sounding element such as a speaker that produces a change in sound pressure. As long as the second sound generation unit 102 has a size that fits in the housing not blocking the ear hole, the second sound generation unit 102 may be any one of a balanced armature type, a piezoelectric type, or an electrostatic type besides a dynamic type speaker, or a combination of two or more types.

Furthermore, in the example shown in FIG. 7, the sound guiding unit 103 has a substantially Y-shape having a branch path for taking in the sound generated from the second sound generation unit 103. Then, this Y-shape is bent to a substantially right angle at the joint unit 105 where they join, forming an L-shape.

Note that the first sound generation unit 101 and the second sound generation unit 102 may include different types of sounding elements from each other. However, regardless of which type of sounding element is utilized, the premises are as described above, in which the first sound generation unit 101 generates a sound in the first frequency band of a low-frequency band, and the second sound generation unit 102 generates a sound in the second frequency band higher than the first frequency band.

In the present embodiment, suppose that the length from the second sound generation unit 102 to the sound emission unit 104 is 20 mm or less. Therefore, the attenuation can be suppressed to be smaller than the case where the acoustic signal generated by the first sound generation unit 101 is propagated by the sound guiding unit 103. Furthermore, by preventing the backflow of the acoustic signal generated from the second sound generation unit 102 to the first sound generation unit 101, the acoustic influence on the first sound generation unit 101 can be suppressed to prevent the deterioration in sound quality.

As described above, the sound generated by the first sound generation unit 101 is influenced by the tube of the sound guiding unit 103 before being emitted from the sound emission unit 104 so that the sound has high-frequency band attenuation as well as a dip in an audible band due to the resonance of the sound guiding unit 103. In the present embodiment, in order to compensate for the high-frequency component attenuated during the propagation through the sound guiding unit 103 and the dip caused by the resonance of the sound guiding unit 103 in the sound generated by the first sound generation unit 101, the second sound generation unit 102 is used.

Figure 8:
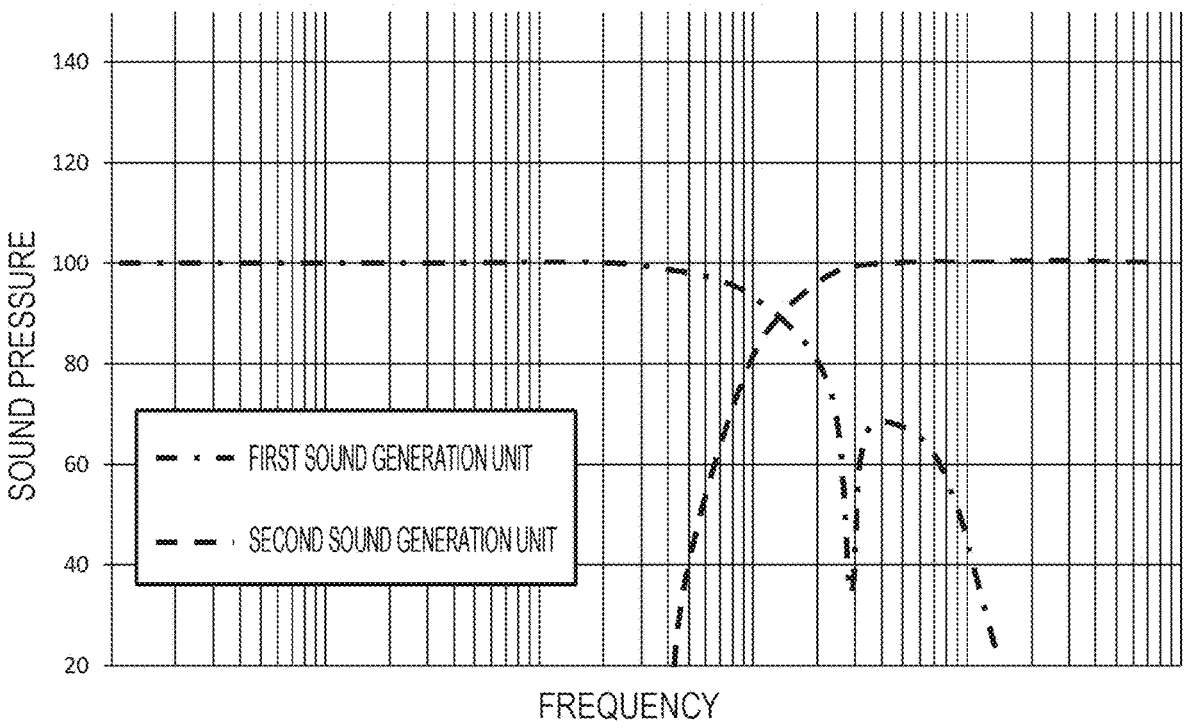
FIG. 8 is a diagram showing the frequency characteristics of the respective acoustic signals generated from the first sound generation unit 101 and the second sound generation unit 102.

FIG. 8 shows the frequency characteristics of the respective acoustic signals generated from the first sound generation unit 101 and the second sound generation unit 102. The acoustic signal generated from the first sound generation unit 101 has high-frequency component attenuation as well as a dip. On the other hand, the second sound generation unit 102 generates an acoustic signal having a high sound pressure mainly in a high-frequency band. Therefore, it can be seen that the attenuation of the high frequency component and the dip of the sound emitted from the first sound generation unit 101 are interpolated by the synthetic output of the first sound generation unit 101 and the second sound generation unit 102.

Here, the speaker used for the second sound generation unit 102 is constituted by a unit for a high-frequency band with stiffness (rigidity) of a vibration system greater than the stiffness of the speaker used for the first sound generation unit 101, thereby suppressing the influence of the sound generated from the first sound generation unit 101 on the diaphragm of the speaker of the second sound generation unit 102. This prevents the deterioration in reproduced sound in the sound output apparatus 100 equipped with a plurality of sound generation units.

Figure 9:
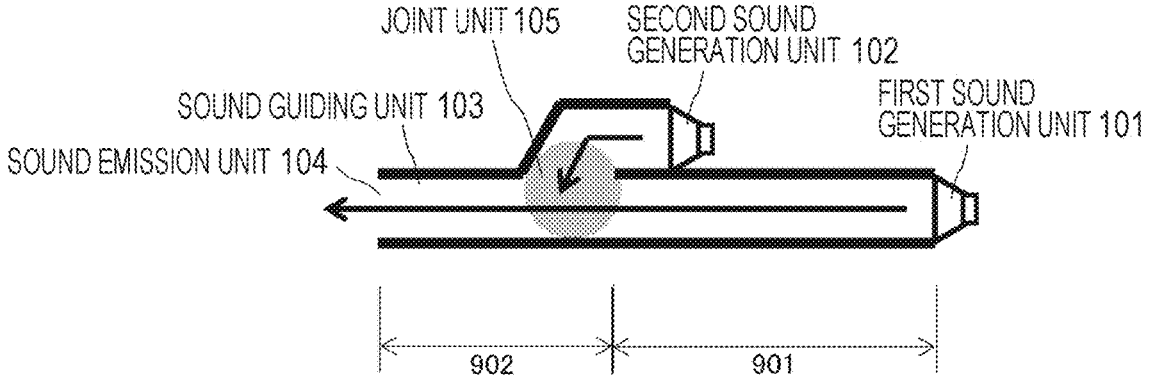
FIG. 9 is a view showing a configuration example of the sound guiding unit 103.

FIG. 9 schematically shows a configuration example of the sound guiding unit 103. The illustrated sound guiding unit 103 has a substantially Y-shape, in which a tube that propagates the acoustic signal generated from the first sound generation unit 101 and a tube that propagates the acoustic signal generated from the second sound generation unit 102 are connected at the joint unit 105. However, the sound guiding unit 103 is constituted such that the tube from the first sound generation unit 101 to the sound emission unit 104 is formed substantially straight and the tube from the second sound generation unit 102 joins from the side face.

The first sound generation unit 101 and the second sound generation unit 102 are disposed such that the front faces of the respective sounding elements (or the openings in the front diaphragm spaces) face the sound emission unit 104. The length from the first sound generation unit 101 to the sound emission unit 104 is about 60 mm to 80 mm. Furthermore, the length from the second sound generation unit 102 to the sound emission unit 104 is 20 mm or less.

At the joint unit 105 provided in the course of the sound guiding unit 103, the acoustic signal generated from the first sound generation unit 101 and the acoustic signal generated from the second sound generation unit 102 are synthesized. As for the acoustic signal generated from the first sound generation unit 101, the high-frequency component is attenuated and a dip occurs due to the resonance of the sound guiding unit 103 before the acoustic signal reaches the sound emission unit 104. However, the attenuation of the high-frequency component and the dip are interpolated by the acoustic signal generated from the second sound generation unit 102. Therefore, the sound emitted from the sound emission unit 104 and heard by the listener exhibits the frequency characteristics having a desired sound pressure over a wide frequency band as shown in FIG. 8.

If the acoustic signal generated from the second sound generation unit 102 flows back to the first sound generation unit 101, there is a concern that the first sound generation unit 101 is influenced acoustically and the sound quality is deteriorated. Thus, it is necessary to prevent the backflow of the acoustic signal generated from the second sound generation unit 102 toward the first sound generation unit 101.

A high-frequency acoustic signal has the property of easily flowing into a lower impedance space. Therefore, in the sound guiding unit 103, a section (indicated by a reference numeral 901) from the first sound generation unit 101 to the joint unit 105 is constituted to have a high impedance, and a section (indicated by a reference numeral 902) from the joint unit 105 to the sound emission unit 104 is constituted to have a low impedance so that the backflow can be prevented.

Methods of constituting the section 901 to have a high impedance include making the inner diameter of the tube in the section 901 thinner than that in the section 902, making the length of the tube in the section 901 longer than that in the section 902, making the inner wall surface in the section 901 rough, providing an interference member at the boundary between the section 901 and the section 902 to interfere with sound waves, and the like. For example, a sponge, a wire mesh, or other porous materials can be used as the interference member. In the present embodiment, suppose that the length from the first sound generation unit 101 to the sound emission unit 104 is about 60 mm to 80 mm, and the length from the second sound generation unit 102 to the sound emission unit 104 is 20 mm or less. The length of the tube in the section 901 is longer than that in the section 902. Therefore, the section 901 has a higher impedance.

Figure 10:
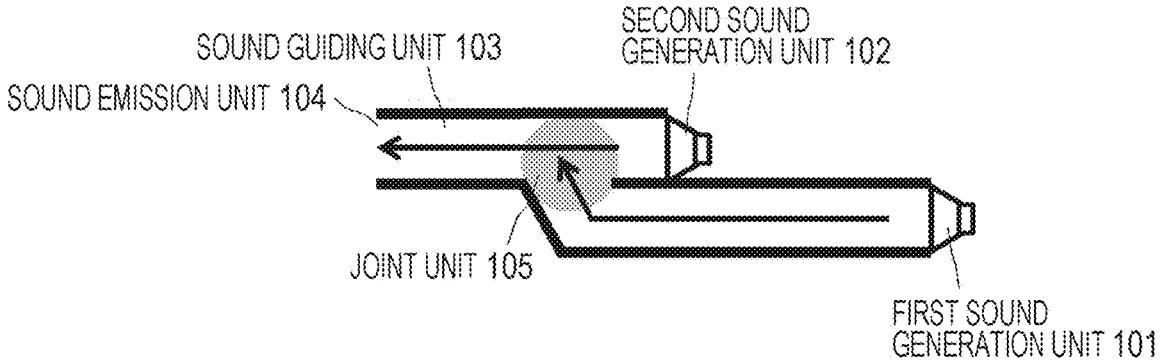
FIG. 10 is a view showing another configuration example of the sound guiding unit 103.

FIG. 10 schematically shows a different configuration example of the sound guiding unit 103. The illustrated sound guiding unit 103 has a substantially Y-shape, in which a tube that propagates the acoustic signal generated from the first sound generation unit 101 and a tube that propagates the acoustic signal generated from the second sound generation unit 102 are connected at the joint unit 105. However, the sound guiding unit 103 shown in FIG. 10 is different from the configuration example shown in FIG. 9 in that the sound guiding unit 103 is constituted so that the tube from the second sound generation unit 102 to the sound emission unit 104 is formed substantially straight and the tube from the first sound generation unit 101 joins from the side face.

Both the first sound generation unit 101 and the second sound generation unit 102 are disposed such that the front faces of the sounding elements (or the openings in the front diaphragm spaces) face the sound emission unit 104. The length from the first sound generation unit 101 to the sound emission unit 104 is about 60 mm to 80 mm. Furthermore, the length from the second sound generation unit 102 to the sound emission unit 104 is 20 mm or less.

At the joint unit 105, the acoustic signal generated from the first sound generation unit 101 and the acoustic signal generated from the second sound generation unit 102 are synthesized. As for the acoustic signal generated from the first sound generation unit 101, the high-frequency component is attenuated and a dip occurs due to the resonance of the sound guiding unit 103 before the acoustic signal reaches the sound emission unit 104. However, the attenuation of the high-frequency component and the dip are interpolated by the acoustic signal generated from the second sound generation unit 102. Therefore, the sound emitted from the sound emission unit 104 and heard by the listener exhibits the frequency characteristics having a desired sound pressure over a wide frequency band as shown in FIG. 8.

Furthermore, in order to prevent the deterioration in the sound quality, it is necessary to prevent the backflow of the acoustic signal generated from the second sound generation unit 102 toward the first sound generation unit 101. A high-frequency acoustic signal has the property of high straightness of advancing. Therefore, by forming the tube from the second sound generation unit 102 to the sound emission unit 104 substantially straight as shown in FIG. 10, the high-frequency acoustic signal generated from the second sound generation unit 102 advances straight to the sound emission unit 104 so that it is difficult to make a detour toward the first sound generation unit 101, and the backflow can be prevented.

As a matter of course, as in the configuration example shown in FIG. 9, by constituting the section from the first sound generation unit 101 to the joint unit 105 to have a high impedance and constituting the section from the joint unit 105 to the sound emission unit 104 to have a low impedance, the backflow of the acoustic signal from the second sound generation unit 102 may be further prevented.

Figure 11:
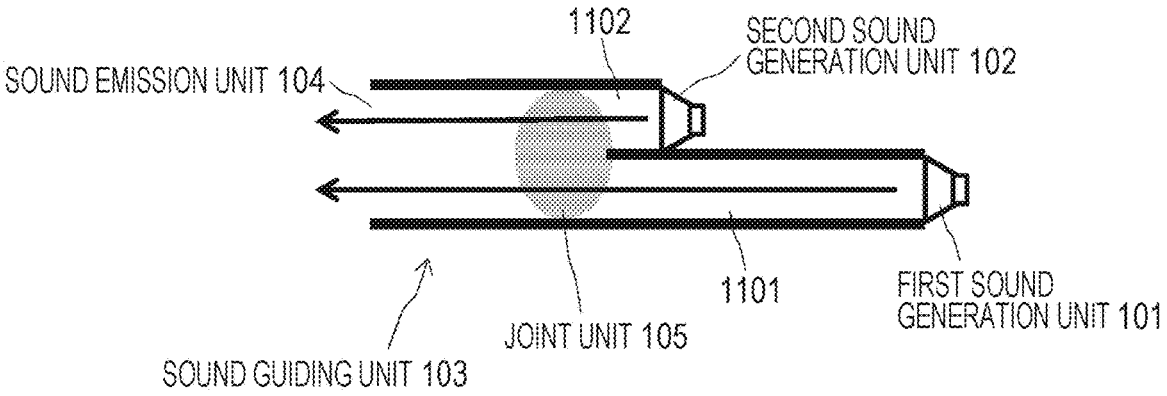
FIG. 11 is a view showing still another configuration example of the sound guiding unit 103.

FIG. 11 schematically shows still another configuration example of the sound guiding unit 103. The illustrated sound guiding unit 103 includes a tube 1101 that propagates an acoustic signal generated from the first sound generation unit 101 and a tube 1102 that propagates an acoustic signal generated from the second sound generation unit 102.

The tubes 1101 and 1102 are arranged substantially parallel to each other and coupled substantially evenly at the joint unit 105 to become a single tube, and then the sound emission unit 104 is formed. The sound guiding unit 103 shown in FIG. 11 is different from the configuration examples shown in FIGS. 9 and 10 in that the tubes 1101 and 1102 are both formed substantially straight and the sound emission unit 104 has an inner diameter obtained by uniting the two tubes 1101 and 1102.

Both the first sound generation unit 101 and the second sound generation unit 102 are attached to one end portions of the respective tubes 1101 and 1102 such that the front faces of the sounding elements (or the openings in the front diaphragm spaces) face the sound emission unit 104. The length from the first sound generation unit 101 to the sound emission unit 104 is about 60 mm to 80 mm. Furthermore, the length from the second sound generation unit 102 to the sound emission unit 104 is 20 mm or less.

At the joint unit 105 in the course of the sound guiding unit 103, the acoustic signal generated from the first sound generation unit 101 and the acoustic signal generated from the second sound generation unit 102 are synthesized. As for the acoustic signal generated from the first sound generation unit 101, the high-frequency component is attenuated and a dip occurs due to the resonance of the sound guiding unit 103 before the acoustic signal reaches the sound emission unit 104. However, the attenuation of the high-frequency component and the dip are interpolated by the acoustic signal generated from the second sound generation unit 102. Therefore, the sound emitted from the sound emission unit 104 and heard by the listener exhibits the frequency characteristics having a desired sound pressure over a wide frequency band as shown in FIG. 8.

In order to prevent the deterioration in the sound quality, it is necessary to prevent the backflow of the acoustic signal generated from the second sound generation unit 102 toward the first sound generation unit 101. A high-frequency acoustic signal has the property of high straightness of advancing. Therefore, since the tube 1102 is formed substantially straight toward the sound emission unit 104 in the configuration example shown in FIG. 11, the high-frequency acoustic signal generated from the second sound generation unit 102 advances straight to the sound emission unit 104 so that it is difficult to make a detour toward the first sound generation unit 101, and the backflow can be prevented.

Furthermore, in the configuration example shown in FIG. 11, the sound guiding unit 103 has a structure in which the tube diameter is expanded after the tubes 1101 and 1102 are united at the joint unit 105. Accordingly, the tube 1101 has a small inner diameter and a high impedance, but the joint unit 105 and the subsequent section have a large inner diameter and a low impedance. Thus, the backflow of the acoustic signal from the second sound generation unit 102 can be prevented. As a matter of course, by making the inner wall surface of the tube 1101 rough or providing an interference member in the vicinity of the joint unit 105 of the tube 1101 to make the impedance of the tube 1101 higher than that of the tube 1102, the backflow of the acoustic signal from the second sound generation unit 102 may be further prevented.

Figure 12:
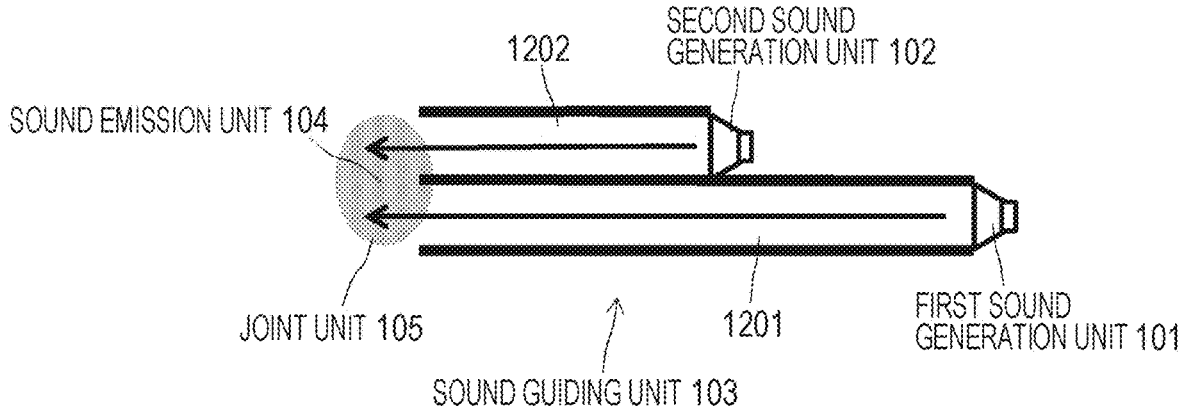
FIG. 12 is a view showing yet another configuration example of the sound guiding unit 103.

FIG. 12 schematically shows yet another configuration example of the sound guiding unit 103. The illustrated sound guiding unit 103 includes a tube 1201 that propagates an acoustic signal generated from the first sound generation unit 101 and a tube 1202 that propagates an acoustic signal generated from the second sound generation unit 102. However, the sound guiding unit 103 shown in FIG. 12 is different from the configuration example shown in FIG. 11 in that the two tubes 1201 and 1202 are not coupled to become a single tube.

Both the first sound generation unit 101 and the second sound generation unit 102 are attached to one end portions of the respective tubes 1201 and 1202 such that the front faces of the sounding elements (or the openings in the front diaphragm spaces) face the sound emission unit 104. Then, the other ends of the respective tubes 1201 and 1202 whose positions are aligned are open ends, forming the sound emission unit 104 and the joint unit 105 of the sound guiding unit 103. The length from the first sound generation unit 101 to the sound emission unit 104 is about 60 mm to 80 mm. Furthermore, the length from the second sound generation unit 102 to the sound emission unit 104 is 20 mm or less.

The acoustic signal generated from the first sound generation unit 101 and the acoustic signal generated from the second sound generation unit 102 are synthesized after being emitted from the sound emission unit 104. It can also be said that the sound emission unit 104 is the joint unit 105. As for the acoustic signal generated from the first sound generation unit 101, the high-frequency component is attenuated and a dip occurs due to the resonance of the sound guiding unit 103 before the acoustic signal reaches the sound emission unit 104. However, the attenuation of the high-frequency component and the dip are interpolated by the acoustic signal generated from the second sound generation unit 102. Therefore, the sound emitted from the sound emission unit 104 and heard by the listener exhibits the frequency characteristics having a desired sound pressure over a wide frequency band as shown in FIG. 8.

Furthermore, since the acoustic signal generated from the first sound generation unit 101 and the acoustic signal generated from the second sound generation unit 102 propagate in the tubes 1201 and 1202 that are independent from each other, one acoustic signal will not flow back toward the other sound generation unit.

Figure 13:
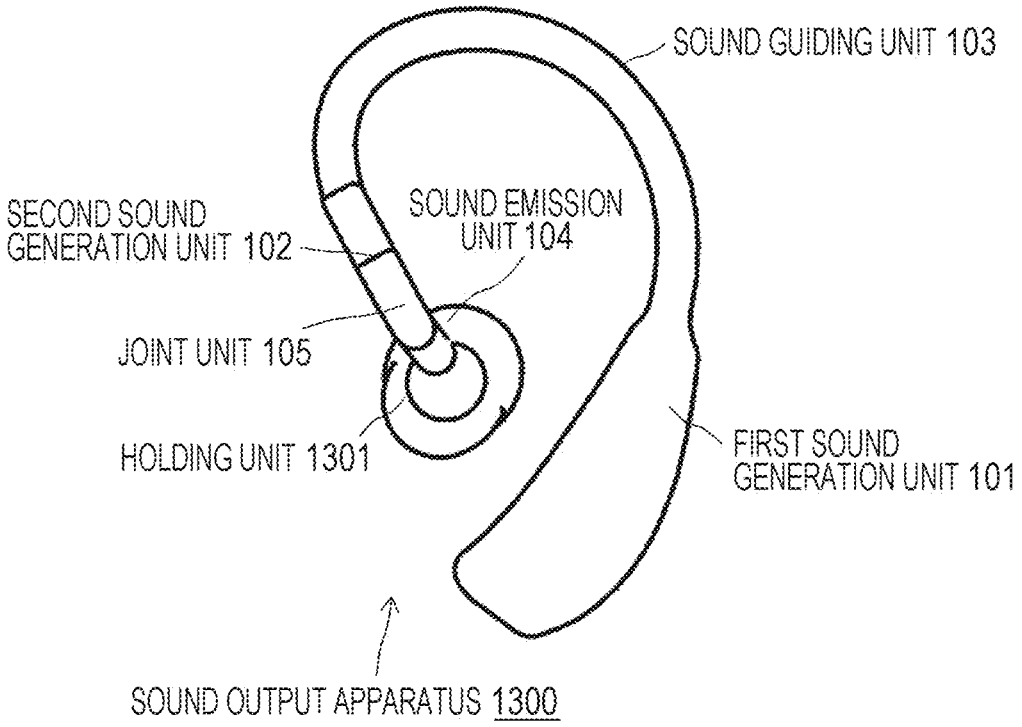
FIG. 13 is a view showing a sound output apparatus 1300 according to another configuration example.

FIG. 13 shows a sound output apparatus 1300 according to another configuration example. The illustrated sound output apparatus 1300 is in common with the sound output apparatus 100 shown in FIG. 1 in that the sound output apparatus 1300 includes a first sound generation unit 101 that generates a low-frequency acoustic signal, a second sound generation unit 102 that generates a high-frequency acoustic signal, and a sound guiding unit 103 that includes a substantially U-shaped hollow tubing material and propagates each of the acoustic signals, and the tip (open end) of the sound guiding unit 103 is a sound emission unit 104. However, the sound output apparatus 1300 is different from the sound output apparatus 100 in that the sound emission unit 104 is held by an annular holding unit 1301.

Figure 14:
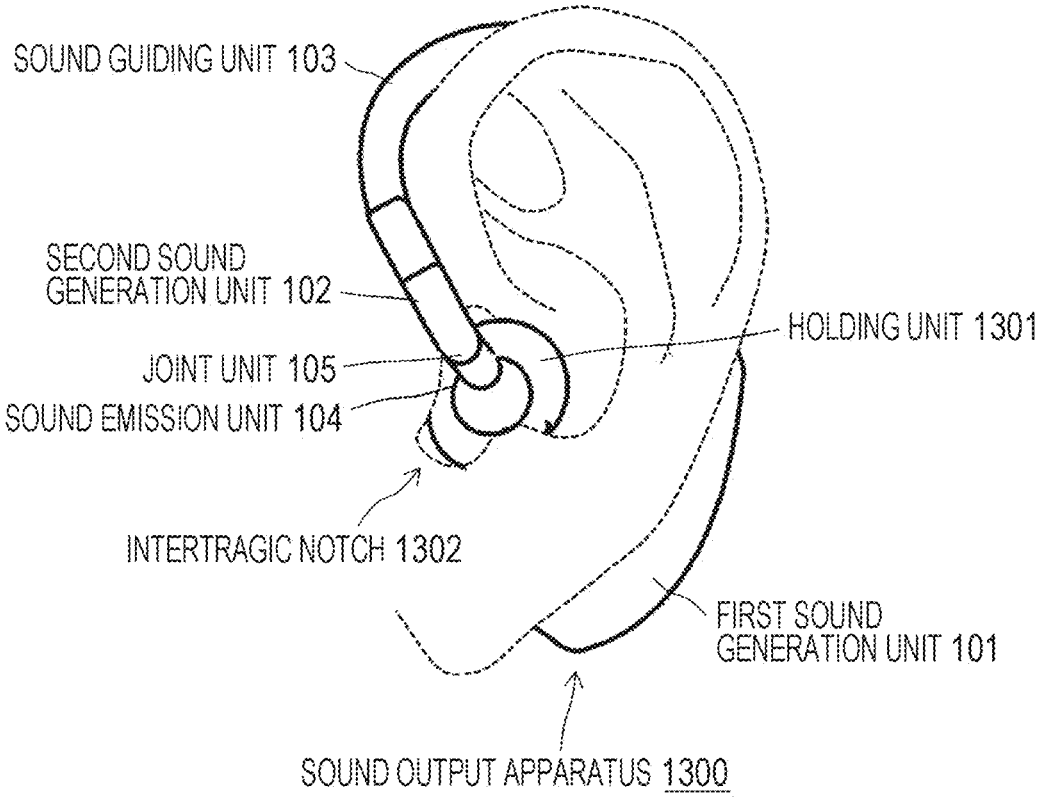
FIG. 14 is a view showing how the sound output apparatus 1300 is worn on the ear of a listener.

FIG. 14 shows how the sound output apparatus 1300 is worn on the ear of a listener. The substantially U-shaped sound guiding unit 103 including an elastic body is hooked onto the helix with the U-shape opening slightly expanded and sandwiches the auricle so that the sound output apparatus 1300 is fixed to the ear of the listener. The sound guiding unit 103 is bent to a substantially right angle at a joint unit 105 and forms an L-shape, and the outer wall of the sound guiding unit 103 in the vicinity of the sound emission unit 104 is engaged with the entrance of the ear canal of the listener. However, the engagement between the sound guiding unit 103 and the entrance of the ear canal is weak, and there is a concern that the orientation of the sound emission unit 104 changes when the listener moves the body or head during use, making the sound difficult to be listened.

On the other hand, in the case of the sound output apparatus 1300, for example, the holding unit 1301 that holds the sound emission unit 104 is inserted into the cavum conchae, which is one of the depressions of the auricle and is locked to the auricle by being hooked to an intertragic notch 1302 formed by a substantially V-shaped notch between the tragus and the antitragus. Accordingly, the wearing stability of the sound output apparatus 1300 is improved, and the position and posture of the sound emission unit 104 can be securely fixed. Furthermore, the holding unit 1301 has an annular structure having an opening that opens the ear hole when the holding unit 1301 is inserted into the cavum conchae.

As shown in FIG. 4 and the like, in a case where the outer wall of the thin cylindrically-shaped sound guiding unit 103 is engaged with the entrance of the ear canal, a relatively strong pressure is applied to the skin (such as the inner wall of the ear canal) of the listener, and the burden is large, causing pain and the like. On the other hand, according to the configuration in which the annular holding unit 1301 that holds the sound emission unit 104 is engaged with the intertragic notch 1302 of the listener as shown in FIGS. 13 and 14, it is possible to reduce the pressure applied to the skin of the listener and improve the comfort at the time of wearing.

Also in the sound output apparatus 1300 shown in FIGS. 13 and 14, the sound guiding unit 103 has one end coupled to the first sound generation unit 101 and the other end being an open end and forming the sound emission unit 104. Furthermore, the second sound generation unit 102 is disposed at a place closer to the sound emission unit 104 than the first sound generation unit 101, and the sound guiding unit 103 takes in, at the joint unit 105, the acoustic signal outputted from the second sound generation unit 102. Therefore, the respective acoustic signals of the sounds in the low-frequency and high-frequency bands generated from the first sound generation unit 101 and the second sound generation unit 102 are synthesized at the joint unit 105 and then emitted toward the ear canal from the sound emission unit 104.

Figure 15:
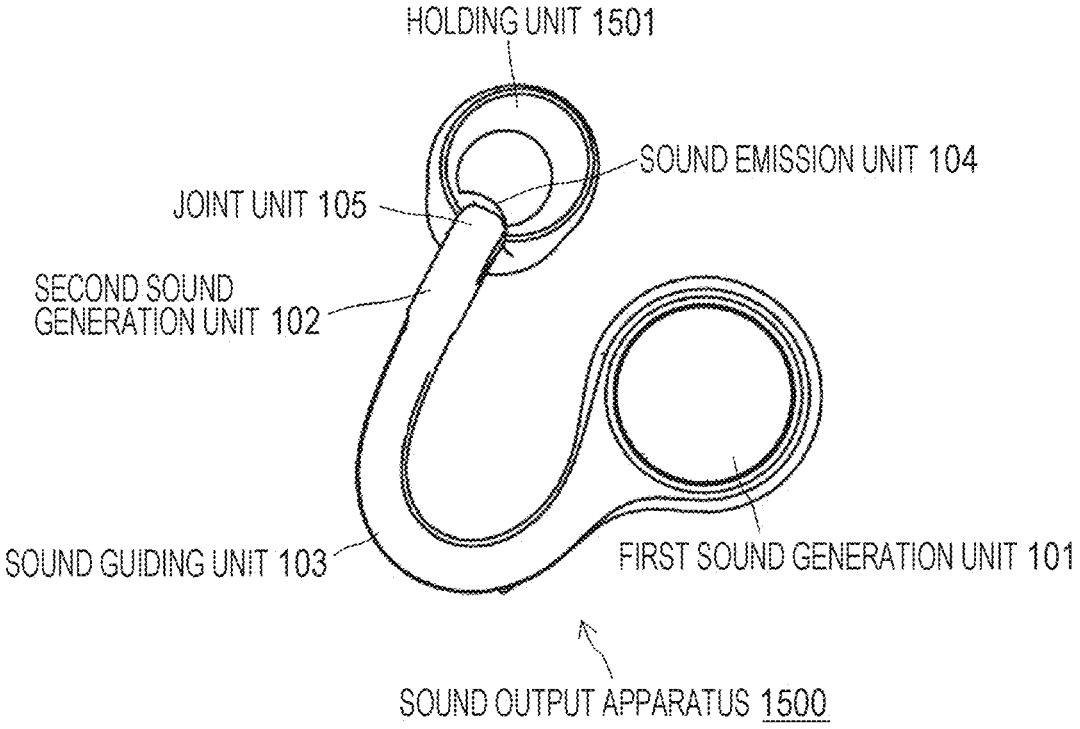
FIG. 15 is a view showing a sound output apparatus 1500 according to still another configuration example.
Figure 16:
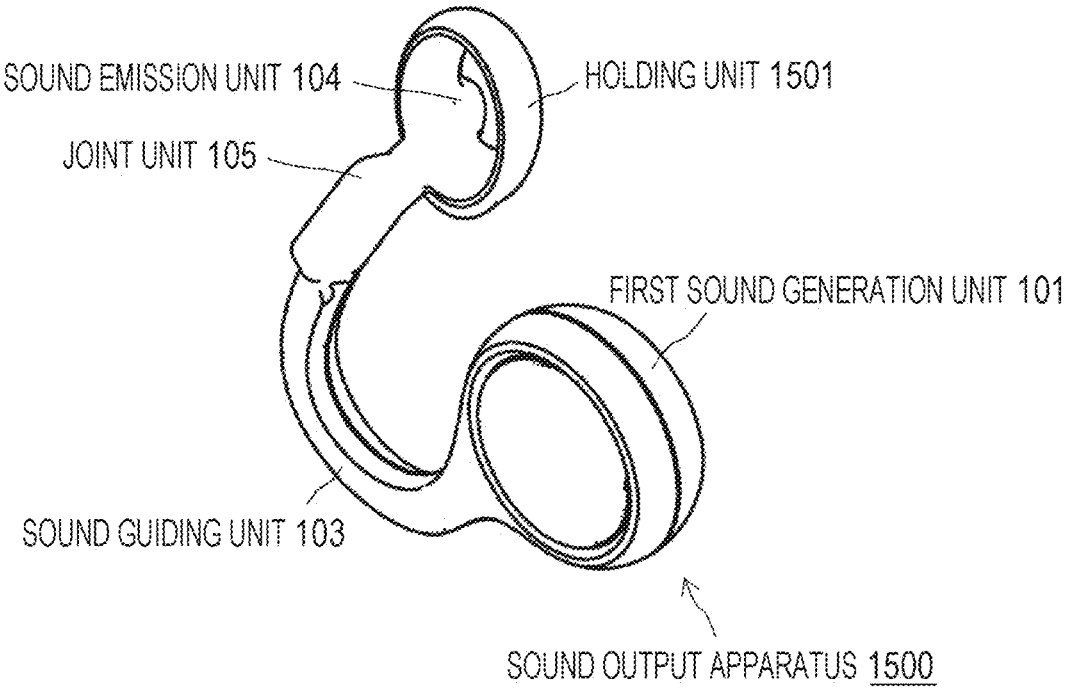
FIG. 16 is a view showing the sound output apparatus 1500 according to still another configuration example.
Figure 17:
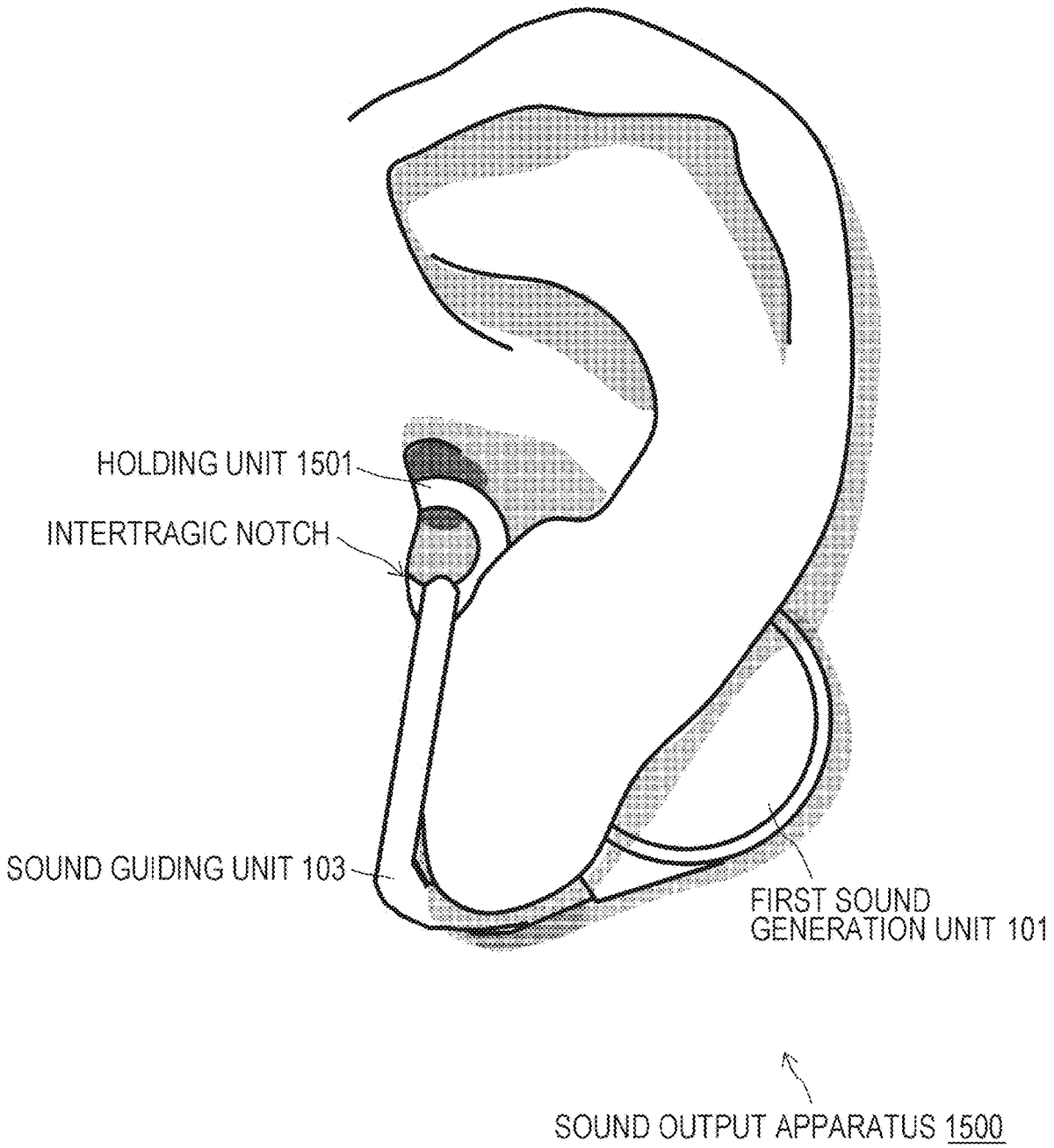
FIG. 17 is a view showing how the sound output apparatus 1500 is worn on the earlobe of a listener.

FIGS. 15 and 16 show a sound output apparatus 1500 having a holding unit according to still another configuration example. Furthermore, FIG. 17 shows how the sound output apparatus 1500 is worn on the earlobe of a listener. The sound output apparatus 1500 is in common with the sound output apparatus 1300 shown in FIG. 13 in that the sound output apparatus 1500 includes a first sound generation unit 101 that generates a low-frequency acoustic signal, a second sound generation unit 102 that generates a high-frequency acoustic signal, and a sound guiding unit 103 that includes a hollow tubing material and propagates each of the acoustic signals, and an annular holding unit 1501 is attached to a sound emission unit 104 at the tip (open end) of the sound guiding unit 103. However, the acoustic output apparatus 1300 shown in FIG. 13 is worn in a usage state by directing a substantially U-shaped opening of the sound guiding unit 103 downward so as to sandwich the upper side of the auricle (see FIG. 14) while the sound output apparatus 1500 is worn by directing a substantially U-shaped opening of the sound guiding unit 103 upward so as to sandwich the lower side of the earlobe.

Also in the sound output apparatus 1500 shown in FIGS. 15 to 17, the sound guiding unit 103 has one end coupled to the first sound generation unit 101 and the other end being an open end and forming the sound emission unit 104. Furthermore, the second sound generation unit 102 is disposed at a place closer to the sound emission unit 104 than the first sound generation unit 101, and the sound guiding unit 103 takes in, at the joint unit 105, the acoustic signal outputted from the second sound generation unit 102. Therefore, the respective acoustic signals of the sounds in the low-frequency and high-frequency bands generated from the first sound generation unit 101 and the second sound generation unit 102 are synthesized at the joint unit 105 and then emitted to the outside by the sound emission unit 104.

Figure 18:
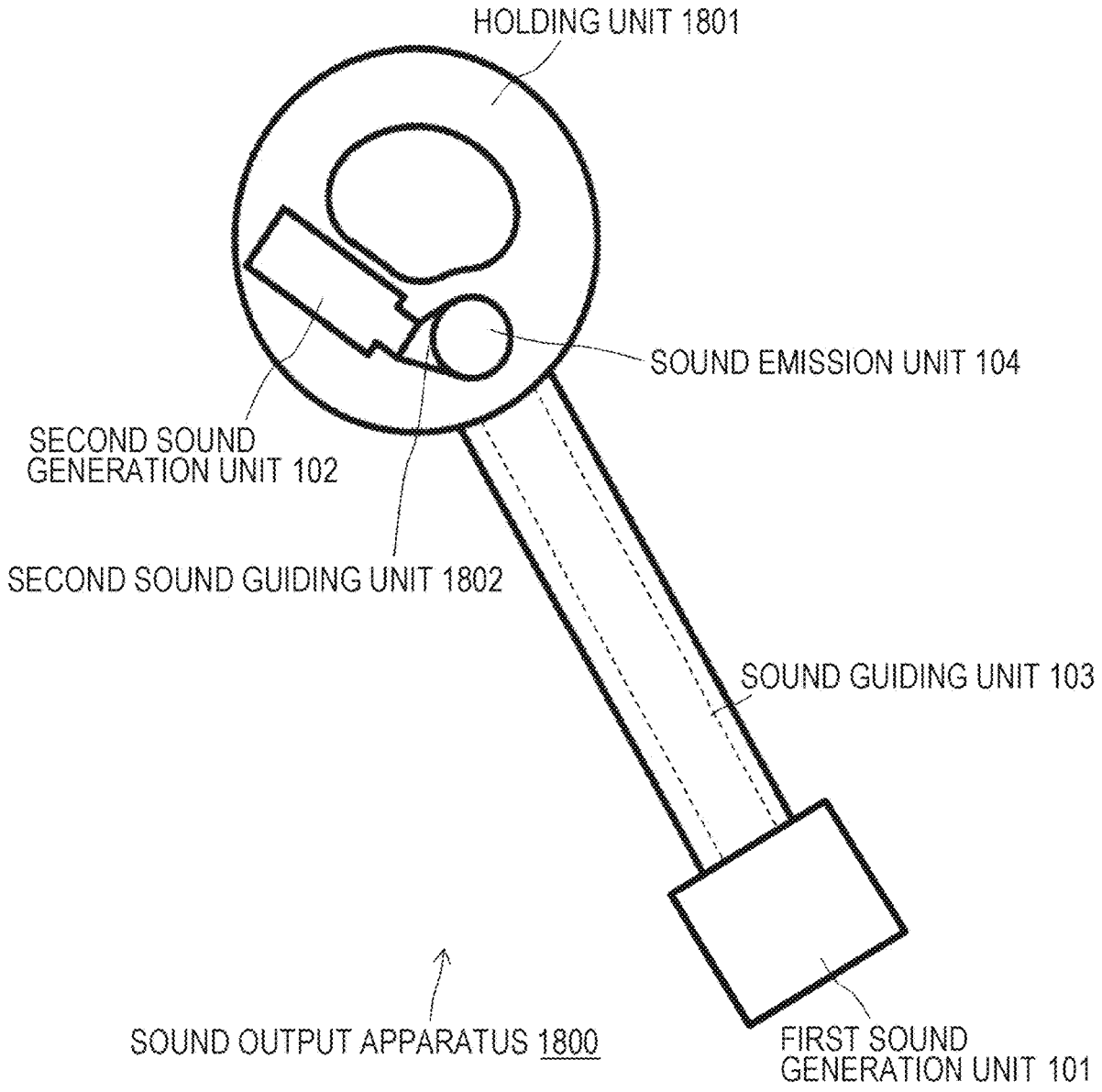
FIG. 18 is a view showing a sound output apparatus 1800 according to yet another configuration example.

FIG. 18 shows a sound output apparatus 1800 according to yet another configuration example. The illustrated sound output apparatus 1800 is in common with the sound output apparatus 1300 shown in FIGS. 13 to 17 in that the sound output apparatus 1800 includes a first sound generation unit 101 that generates a low-frequency acoustic signal, a second sound generation unit 102 that generates a high-frequency acoustic signal, a sound guiding unit 103 that propagates the acoustic signals, and an annular holding unit 1801 that holds a sound emission unit 104 at the tip of the sound guiding unit 103.

However, the sound output apparatus 1800 is different from the sound output apparatus 1300 in that the second sound generation unit 102 is accommodated in the holding unit 1801. Furthermore, the sound output apparatus 1800 is also different from the sound output apparatus 1300 in that a second sound guiding unit 1802 that propagates the acoustic signal generated from the second sound generation unit 102 is formed in the holding unit 1801.

Furthermore, in the sound output apparatus 1800, the sound guiding unit 103 propagates only the acoustic signal generated from the first sound generation unit 101 and joins the second sound guiding unit 1802 in the holding unit 1801 (the illustration of a joint unit is omitted in FIG. 18). Alternatively, the sound guiding unit 103 and the second sound guiding unit 1802 may not be joined and may be provided with separate respective sound emission units at the holding unit 1802.

Note that the circular annular holding unit is illustrated in FIGS. 13 to 18, but the holding unit has a shape that is compatible with the shape of the ear of the listener, such as a quadrangle shape or a crescent shape, and can adopt various shapes besides an annular shape as long as the structure thereof has an opening which opens the ear hole.

Furthermore, the holding unit is not limited to a shape with a hole like a ring and may have a structure that is engaged with the vicinity of the entrance of the ear canal of the listener and seals from the sound emission unit to the eardrum of the listener.

Furthermore, the sound guiding unit can adopt various shapes, such as straight, spiral and curves that match the shape of the ear, besides the U-shape in any of the cases where the sound guiding unit is attached to the upper side of the auricle or the lower side of the earlobe as long as the sound guiding unit has a hollow structure that can propagate sound waves.

Hereinbefore, the sound output apparatuses have been introduced, each including the two sound generation units, the first sound generation unit that generates a low-frequency acoustic signal and the second sound generation unit that generates a high-frequency acoustic signal, in which each of the acoustic signals is propagated to the vicinity of the entrance of the ear canal by the sound guiding unit. Furthermore, each of the sound output apparatuses has been described to have a feature of being "ear-hole open type" by the constitution in which the first sound generation unit 101 is arranged at a place away from the ear hole and the acoustic signals are propagated to the entrance of the ear canal through the sound guiding unit although the first sound generation unit 101 that generates a low-frequency sound becomes relatively large.

The resonance frequency in the sound guiding unit is determined by the length of the sound guiding unit, and the frequency at which the dip occurs is different. The listener hears not the sound itself generated by the first sound generation unit 101, but a sound having high-frequency attenuation and a dip at a specific frequency after the sound propagates through the sound guiding unit. Each of the above-described sound output apparatuses including the two sound generation units is configured to interpolate, with the acoustic signal from the second sound generation unit 102, the high-frequency attenuation and the dip of the acoustic signal from the first sound generation unit 101 and output an acoustic signal having a desired sound pressure over a wide frequency band (see FIG. 8).

Figure 19:
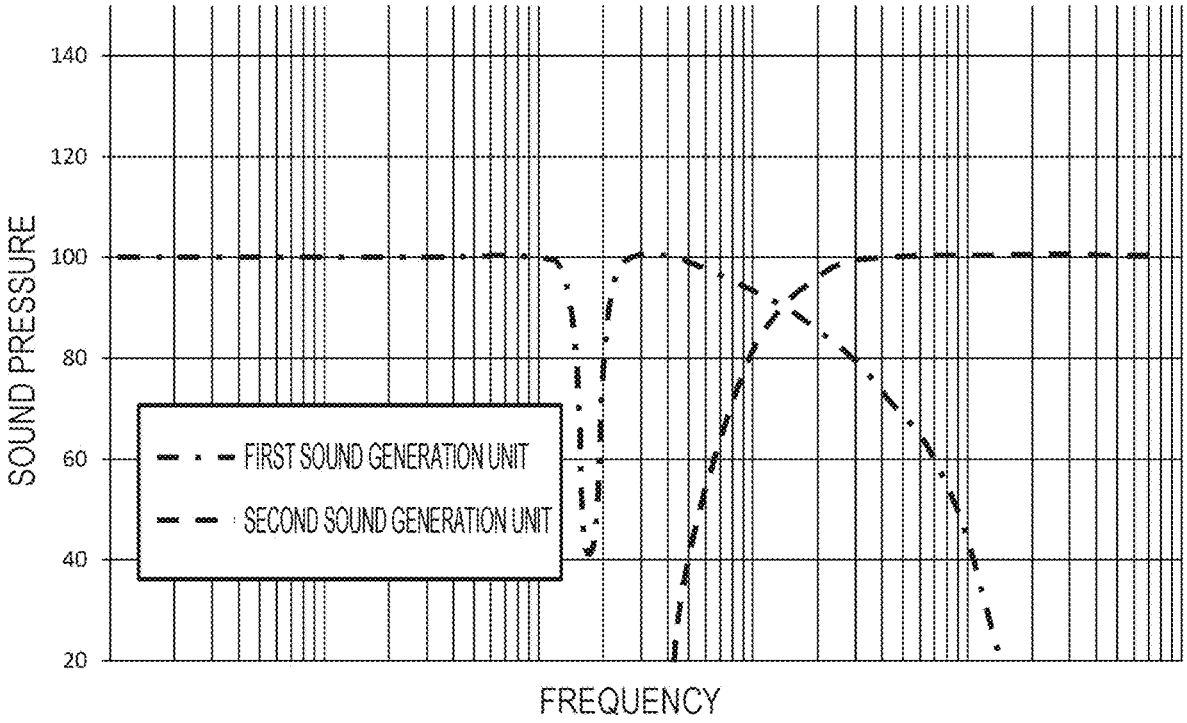
FIG. 19 is a diagram showing an example of the frequency characteristics in a case where a dip occurred in the acoustic signal from the first sound generation unit cannot be interpolated by the acoustic signal from the second sound generation unit.
Figure 20:
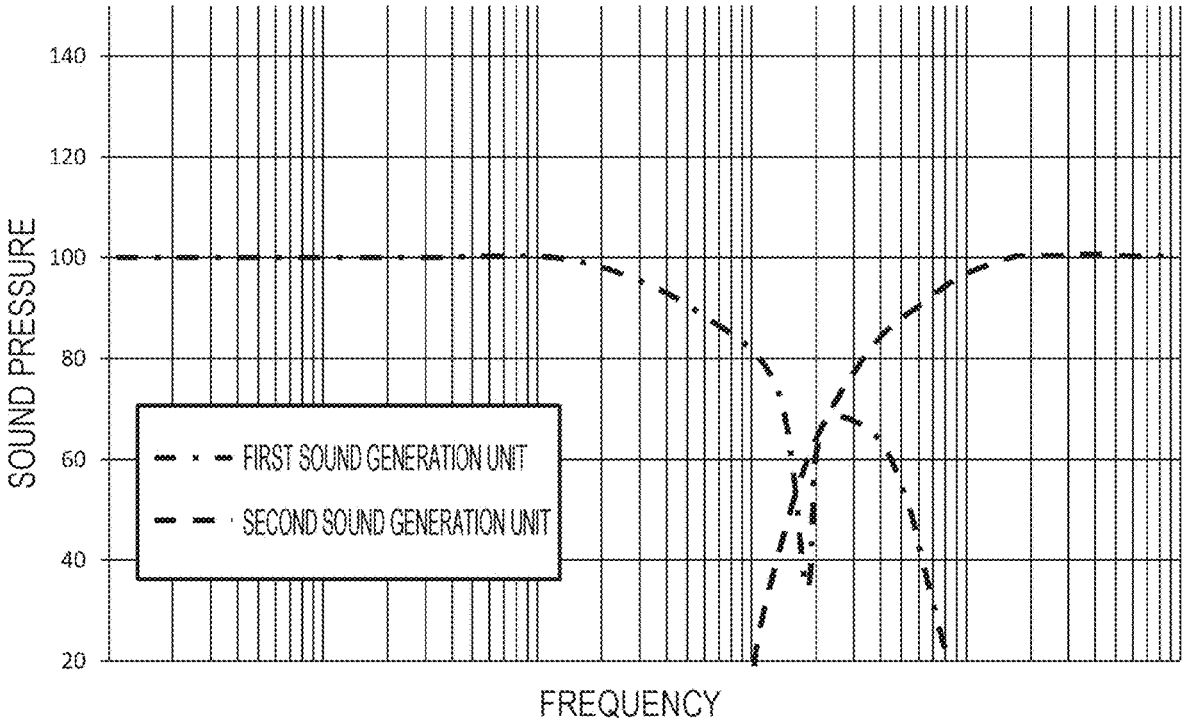
FIG. 20 is a diagram showing an example of the frequency characteristics in a case where a relatively low frequency band of the high frequency band, in which the attenuation occurs in the acoustic signal from the first sound generation unit, cannot be sufficiently interpolated by the acoustic signal from the second sound generation unit.

However, in a case where the frequency at which the dip occurs and the frequency band with the high-frequency attenuation are different in the acoustic signal delivered to the ear hole from the first sound generation unit through the sound guiding unit, the dip cannot be interpolated with only the acoustic signal from the second sound generation unit (see FIG. 19). Furthermore, depending on the characteristics of the second sound generation unit, there may be a case where sufficient sound pressure cannot be obtained for desired characteristics in a relatively low frequency band (or mid-frequency band) of the high-frequency band where the attenuation occurs in the acoustic signal from the first sound generation unit (see FIG. 20).

Therefore, a third sound generation unit that mainly generates a mid-frequency acoustic signal may be disposed additionally in the sound output apparatus to interpolate the high-frequency attenuation or the dip in the acoustic signal delivered to the ear hole from the first sound generation unit through the sound guiding unit.

Figure 21:
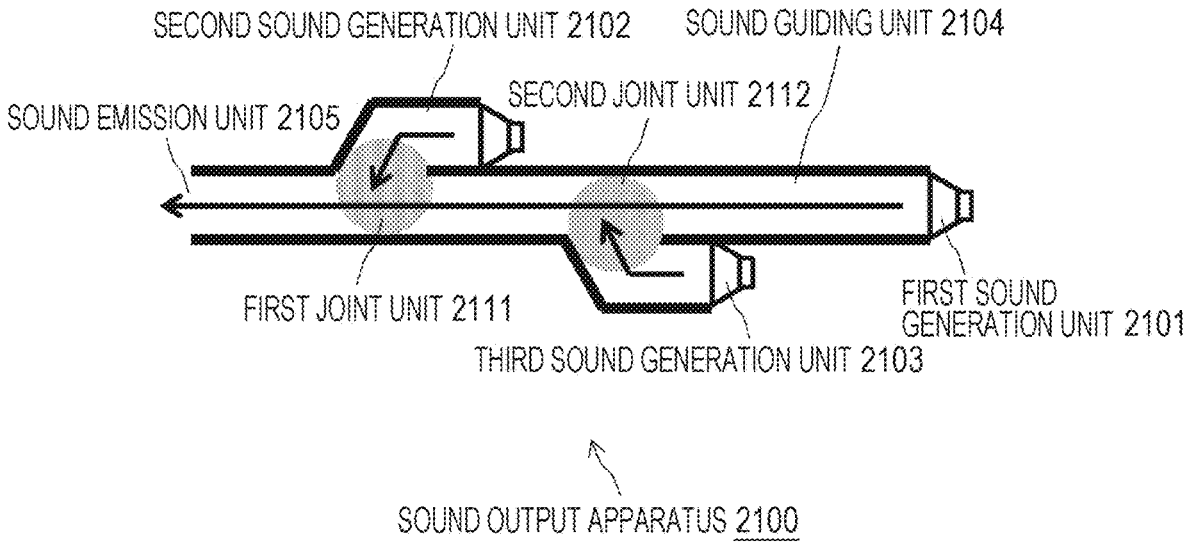
FIG. 21 is a view showing a configuration example of a sound guiding unit that propagates the acoustic signals from the respective first to third sound generation units.

FIG. 21 schematically shows a configuration example of a sound generation apparatus 2100 including a sound guiding unit 2104 that propagates respective acoustic signals of the sounds in low-frequency, high-frequency, and mid-frequency bands generated from a first sound generation unit 2101, a second sound generation unit 2102, and a third sound generation unit 2103, respectively.

The sound guiding unit 2104 is constituted such that a tube that propagates the acoustic signal generated from the first sound generation unit 2101 is connected to, at a first joint unit 2111, a tube that propagates the acoustic signal generated from the second sound generation unit 2102 as well as is connected to, at a second joint unit 2112, a tube that propagates the acoustic signal generated from the third sound generation unit 2103. Furthermore, the other end of the sound guiding unit 2104 is an open end and is a sound emission unit 2105 that emits an acoustic signal obtained by synthesizing the acoustic signals from the respective sound generation units 2101 to 2103. The first joint unit 2111 is disposed at a place closer to the sound emission unit 2105 than the second joint unit 2112.

The first sound generation unit 2101, the second sound generation unit 2102, and the third sound generation unit 2103 are disposed such that the front faces of the respective sounding elements (or the openings in the front diaphragm spaces) face the sound emission unit 2105. As described above, the first sound generation unit 2101 mainly generates the low-frequency acoustic signal, the second sound generation unit 2102 mainly generates the high-frequency acoustic signal, and the third sound generation unit 2103 mainly generates the mid-frequency acoustic signal. As long as each of the sound generation units 2101 to 2103 is within the allowable range of the limitation of design, such as size, each of the sound generation units 2101 to 2103 may be any one of a balanced armature type, a piezoelectric type, or an electrostatic type besides a dynamic type speaker, or a combination of two or more types.

In consideration of the characteristics that the higher frequency signal is easier to be attenuated, the second sound generation unit 2102, the third sound generation unit 2103, and the first sound generation unit 2101 are disposed in this order from the sound emission unit 2105. The length from the first sound generation unit 2101 to the sound emission unit 2105 is about 60 mm to 80 mm. Furthermore, the length from the second sound generation unit 2102 to the sound emission unit 2105 is 20 mm or less.

Figure 22:
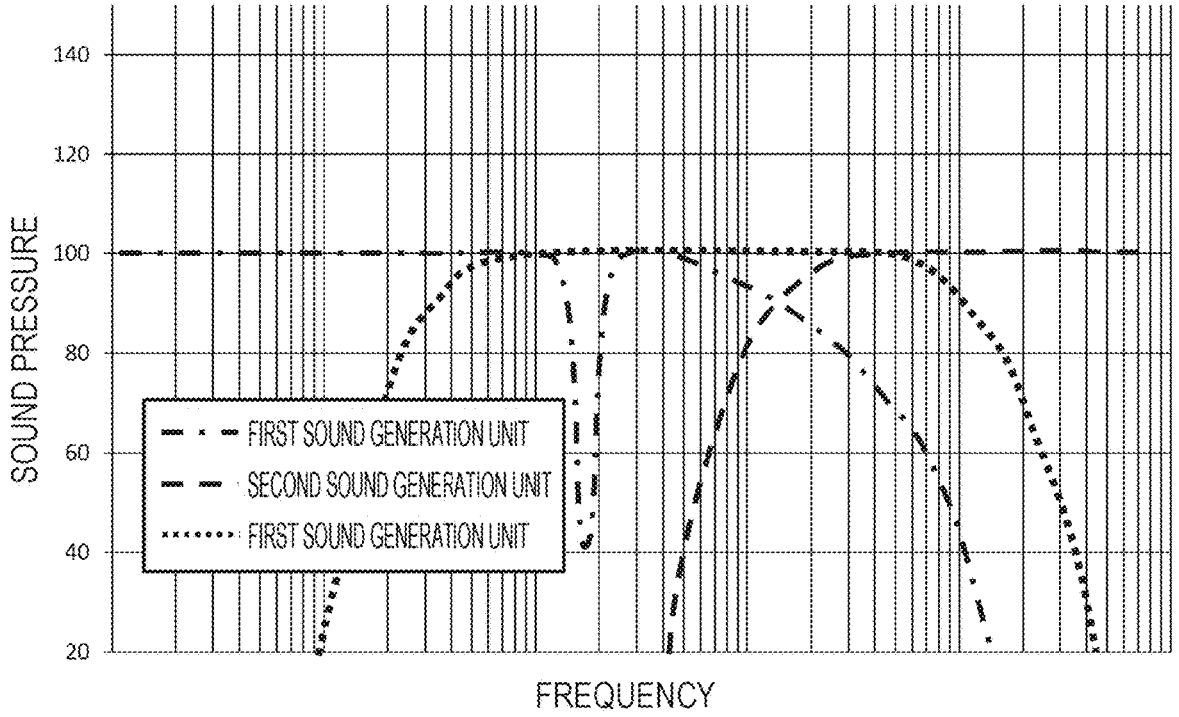
FIG. 22 is a diagram exemplifying the frequency characteristics of the acoustic signals generated from the respective first to third sound generation units.
Figure 23:
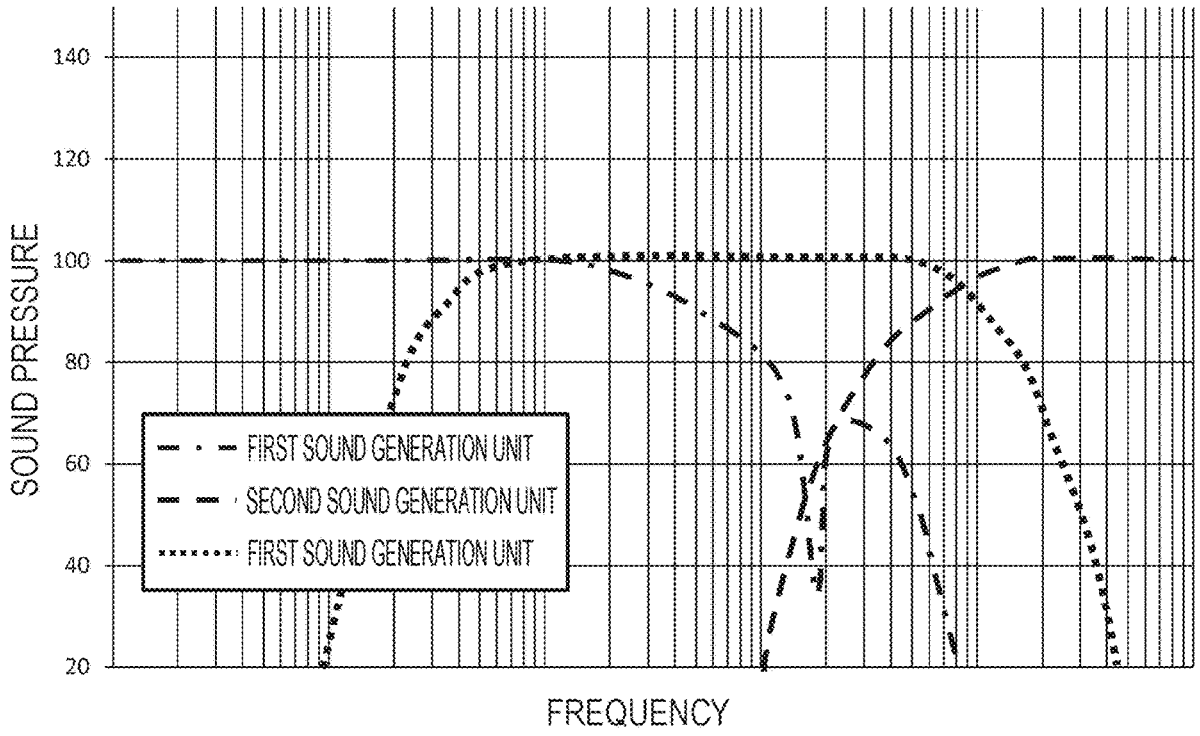
FIG. 23 is a diagram exemplifying the frequency characteristics of the acoustic signals generated from the respective first to third sound generation units.

A high-frequency acoustic signal is mainly generated from the first sound generation unit 2101, a low-frequency acoustic signal is mainly generated from the second sound generation unit 2102, and a mid-frequency acoustic signal is mainly generated from the third sound generation unit 2103. Furthermore, a high-frequency component that is attenuated and a dip occurred by the resonance before the acoustic signal generated from the first sound generation unit 2101 reaches the sound emission unit 2105 through the sound guiding unit 2104 are interpolated with the mid-frequency acoustic signal by the third sound generation unit 2103. Therefore, the sound emitted from the sound emission unit 2105 and heard by the listener exhibits the frequency characteristics having a desired sound pressure over a wide frequency band (see FIGS. 22 and 23).

Furthermore, if the acoustic signal generated from the second sound generation unit 2102 flows back, this acoustically influences the first sound generation unit 2101 and the third sound generation unit 2103, and the sound quality is deteriorated. Similarly, if the acoustic signal generated from the third sound generation unit 2103 flows back, this acoustically influences the first sound generation unit 2101, and the sound quality is deteriorated. Accordingly, it is necessary to prevent the backflow of each of the acoustic signals.

A high-frequency acoustic signal has the property of easily flowing into a lower impedance space. Therefore, the sound emission unit 2105 side from the first joint unit 2111 should be constituted to have a lower impedance than the opposite side. Similarly, the sound emission unit 2105 side from the second joint unit 2112 should be constituted to have a lower impedance than the opposite side. As described above, the impedance differences can be formed by a method of adjusting the inner diameter of the tube, adjusting the roughness of the inner wall surface of the tube, providing an interference member in the tube, or the like.

FIGS. 24 to 28 show specific configuration examples of a sound output apparatus 2400 including three sound generation units that generate high-frequency, mid-frequency, and low-frequency acoustic signals, respectively.

Figure 24:
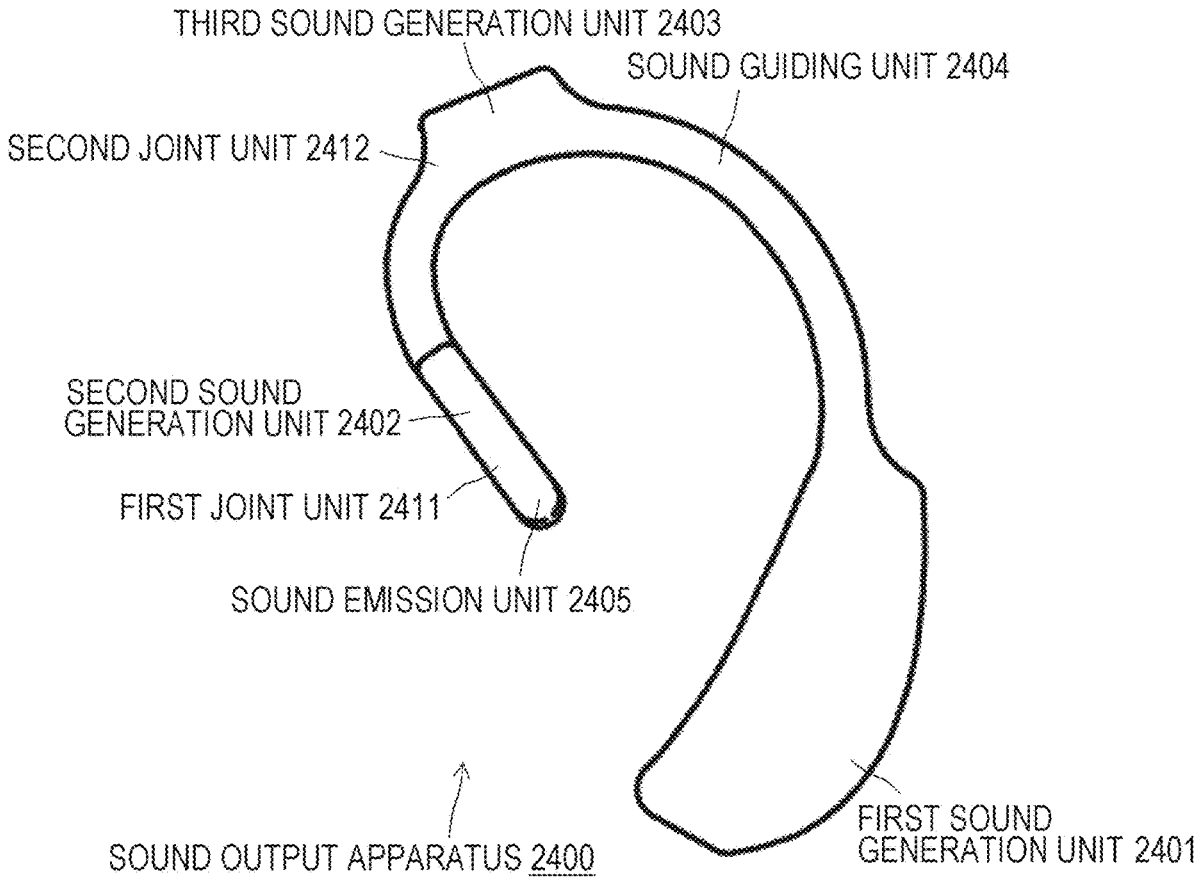
FIG. 24 is a view showing a configuration example of a sound output apparatus 2400 including three sound generation units.
Figure 25:
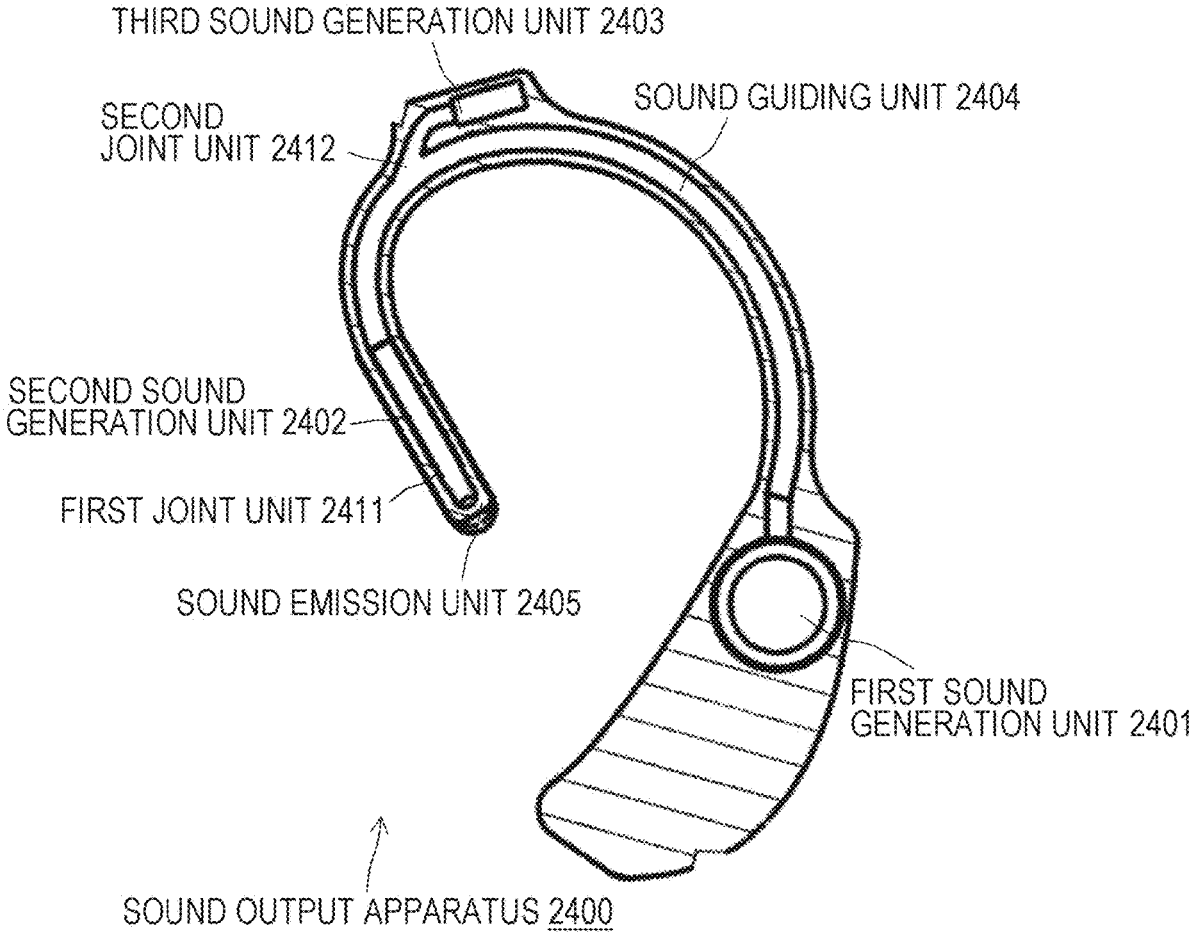
FIG. 25 is a view showing a configuration example of the sound output apparatus 2400 including the three sound generation units.
Figure 26:
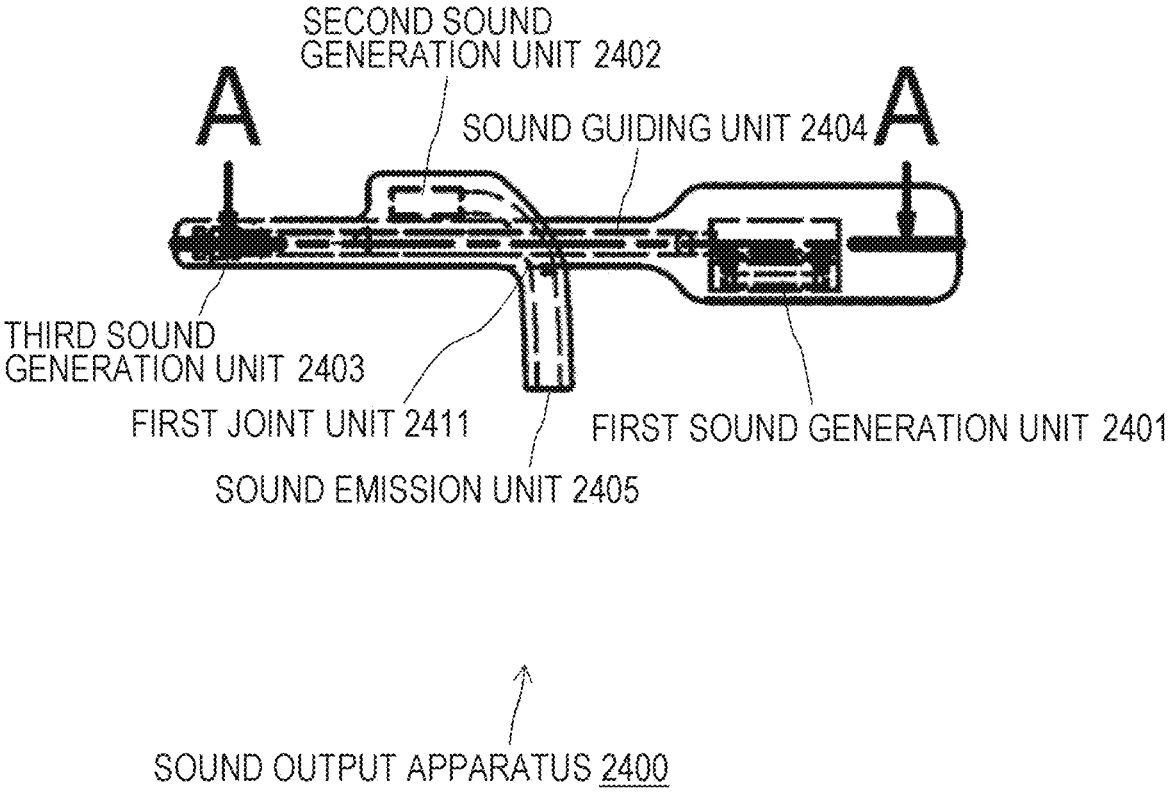
FIG. 26 is a view showing a configuration example of the sound output apparatus 2400 including the three sound generation units.
Figure 27:
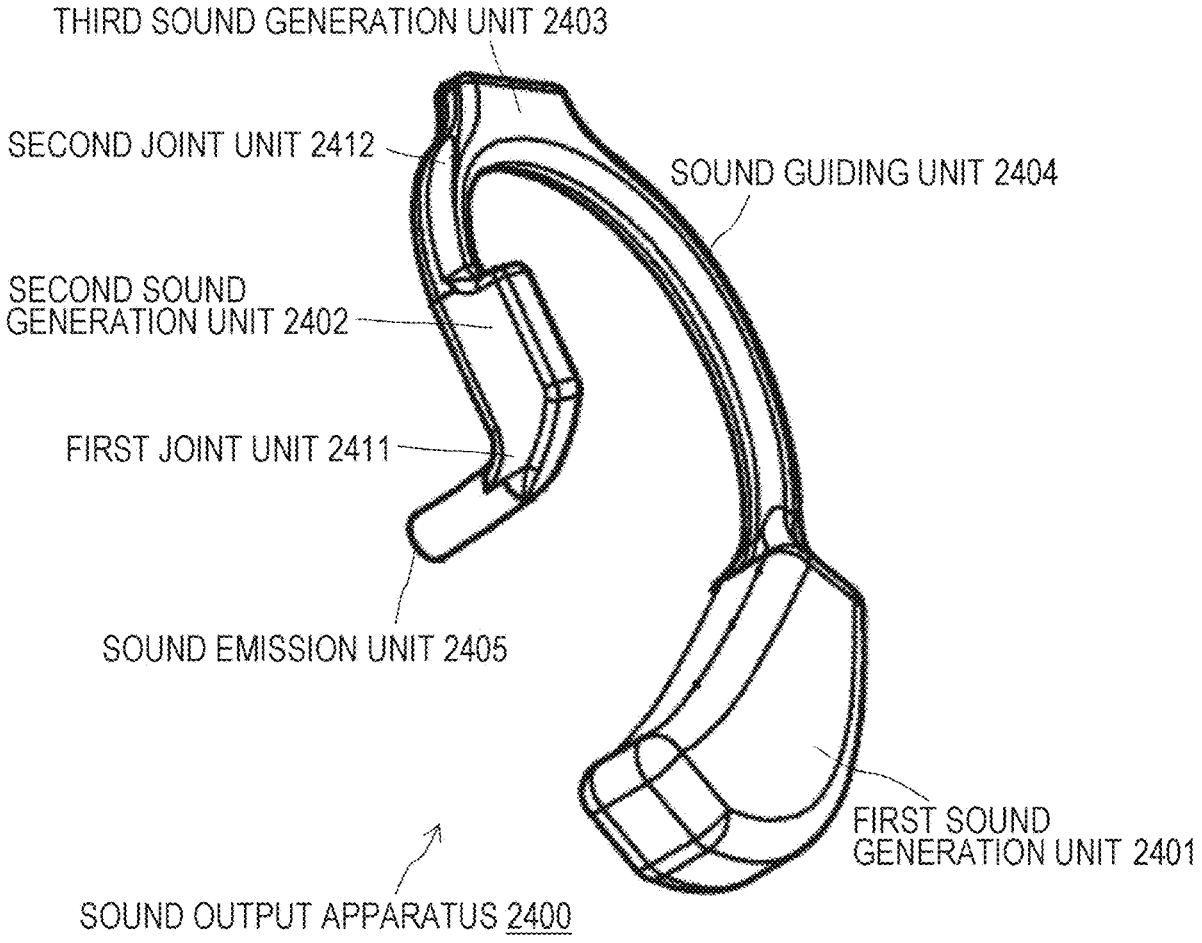
FIG. 27 is a view showing a configuration example of the sound output apparatus 2400 including the three sound generation units.
Figure 28:
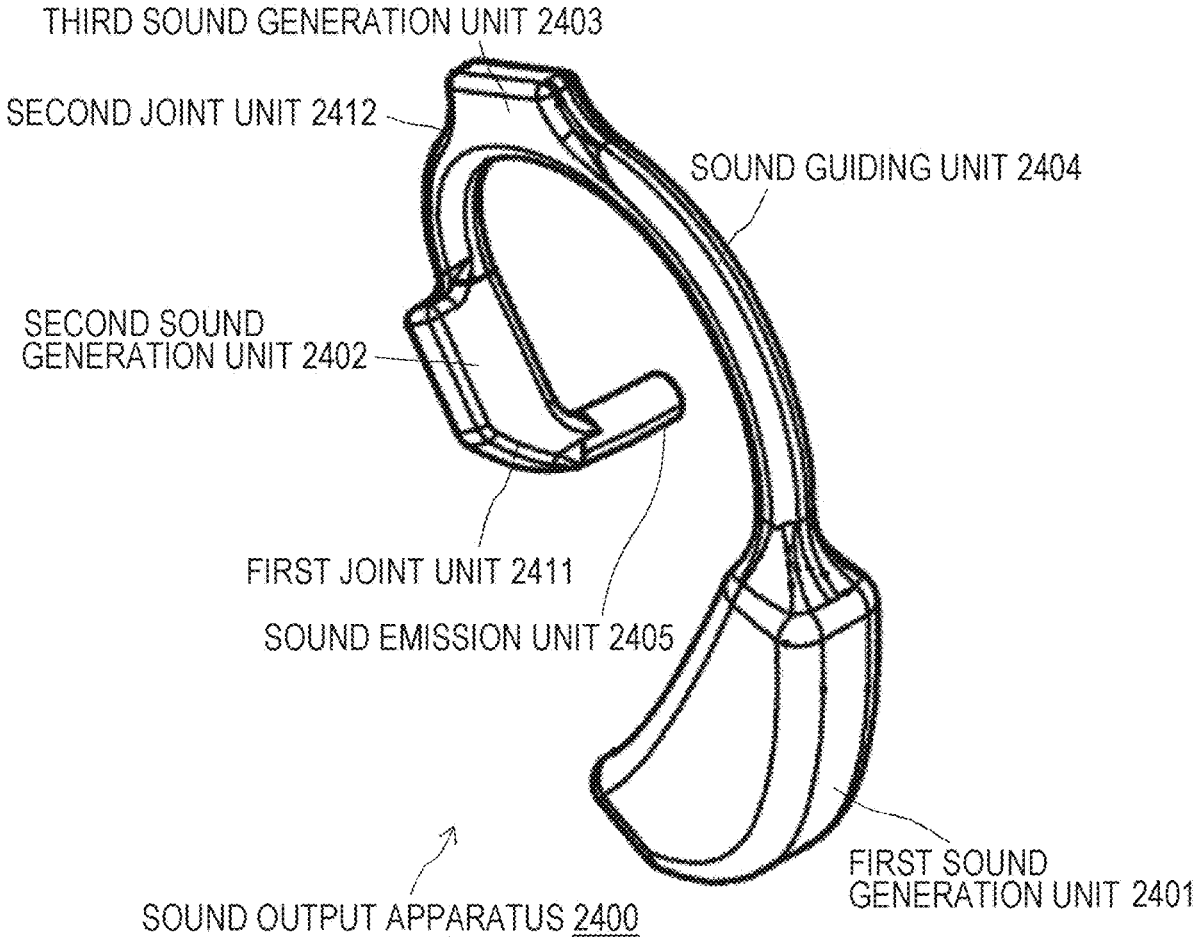
FIG. 28 is a view showing a configuration example of the sound output apparatus 2400 including the three sound generation units.

The illustrated sound output apparatus 2400 includes a first sound generation unit 2401, a second sound generation unit 2402, a third sound generation unit 2403, and a sound guiding unit 2404. The first sound generation unit 2401 mainly generates a low-frequency sound, the second sound generation unit 2402 mainly generates a high-frequency sound, and the third sound generation unit 2403 mainly generates a mid-frequency sound. The sound guiding unit 2404 transmits the respective acoustic signals outputted from the first to third sound generation units 2401 to 2403 to the vicinity of the entrance of the ear canal of a listener. The sound guiding unit 2404 includes a hollow tubing material. FIG. 24 is a plan view substantially parallel to the axis of this tube, FIG. 25 is a cross-sectional view cut along a plane including the axis of this tube, and FIG. 26 is a cross-sectional view cut along a plane orthogonal to the plane including the axis. Furthermore, FIG. 27 is a perspective view of the sound output apparatus 2400 as viewed from a direction inclined from the normal line of the plane including the axis of the sound guiding unit 2404, and FIG. 28 is a perspective view of the sound output apparatus 240 as viewed from the opposite side of FIG. 27. Note that each drawing shows a configuration example of the sound output apparatus 2400 for the left ear, and the sound output apparatus for the right ear has a similar configuration in a mirror-reversed manner.

As can be seen from FIG. 25, the sound guiding unit 2404 has one end coupled to the first sound generation unit 2401 and the other end being an open end and forming a sound emission unit 2405. Therefore, the acoustic signal generated from the first sound generation unit 2401 is taken in from the one end of the sound guiding unit 2404, propagates through the tube and advances toward the sound emission unit 2405.

Furthermore, in the course of the sound guiding unit 2404, the second sound generation unit 2402 and the third sound generation unit 2403 are disposed in this order from the sound emission unit 2405. Furthermore, the sound guiding unit 2404 includes a first joint unit 2411 that takes in the acoustic signal outputted from the second sound generation unit 2402 and a second joint unit 2412 that takes in the acoustic signal outputted from the third sound generation unit 2403. Therefore, the respective acoustic signals of the sounds in the low-frequency, high-frequency, and mid-frequency bands generated from the first sound generation unit 2401, the second sound generation unit 2402, and the third sound generation unit 2403, respectively, are synthesized in the sound guiding unit 2404 and then emitted to the outside by the sound emission unit 2405. The sound output apparatus 100 as a whole can reproduce sound having a desired sound pressure over a wide frequency band from a low-frequency band to a high-frequency band.

It is necessary to prevent the backflow of the respective acoustic signals generated from both the second sound generation unit 2402 and the third sound generation unit 2403. A high-frequency acoustic signal has the property of easily flowing into a lower impedance space. Therefore, the sound emission unit 2405 side from the first joint unit 2411 is constituted to have a lower impedance than the opposite side. Similarly, the sound emission unit 2405 side from the second joint unit 2412 should be constituted to have a lower impedance than the opposite side.

As can be seen from FIGS. 27 and 28, the sound guiding unit 2404 is bent to a substantially right angle in the vicinity of before the sound emission unit 2405 and forms an L-shape. Therefore, when the sound output apparatus 2400 is worn on the ear of the listener, the bent portion of the sound guiding unit 2404 reaches the entrance of the ear canal, the bent sound emission unit 2405 is directed toward the entrance of the ear canal, and the outer wall of the sound guiding unit 2404 in the vicinity of the sound emission unit 2405 is engaged with the entrance of the ear canal of the listener. Note that, although the illustration is omitted in the drawing, an annular holding unit (previously mentioned), which is configured to hold the sound emission unit 2405 and be hooked to the intertragic notch of the listener, may be further provided.

In the sound output apparatus 2400 shown in FIGS. 24 to 28, the second sound generation unit 2402, the third sound generation unit 2403, and the first sound generation unit 2401 are disposed in this order from the sound emission unit 2405. By arranging the first sound generation unit 2401, which generates a low-frequency sound and is relatively large, at a place away from the sound emission unit 2405, the sound output apparatus 2405 can have a feature of opening the ear hole of the listener, that is, an ear-hole open type. Furthermore, by arranging the second sound generation unit 2402, which generates a high-frequency sound with high attenuation, at the place closest to the sound emission unit 2405, good sound with a balanced sound pressure over the low-frequency, mid-frequency and high-frequency bands can be heard by the listener.

Finally, a circuit configuration of the above-described sound output apparatus including a plurality of sound generation units that generates a sound in each of the frequency bands will be described.

When a signal including a low-frequency component with large amplitude is inputted into the second sound generation unit responsible for the high-frequency band, this may possibly lead to distortion occurrence and damage to the sounding elements. Such a problem can be solved by dividing the frequency band of the signals inputted into the respective sound generation units into the responsible frequency bands of the respective sound generation units. Furthermore, since each sound generation unit outputs an acoustic signal in which components in the frequency bands other than the responsible frequency bands of the respective sound generation units are suppressed, there is also an effect of being capable of suppressing unnatural emphasis in the frequency bands where the reproducible frequency bands of the respective sound generation units overlap.

Figure 29:
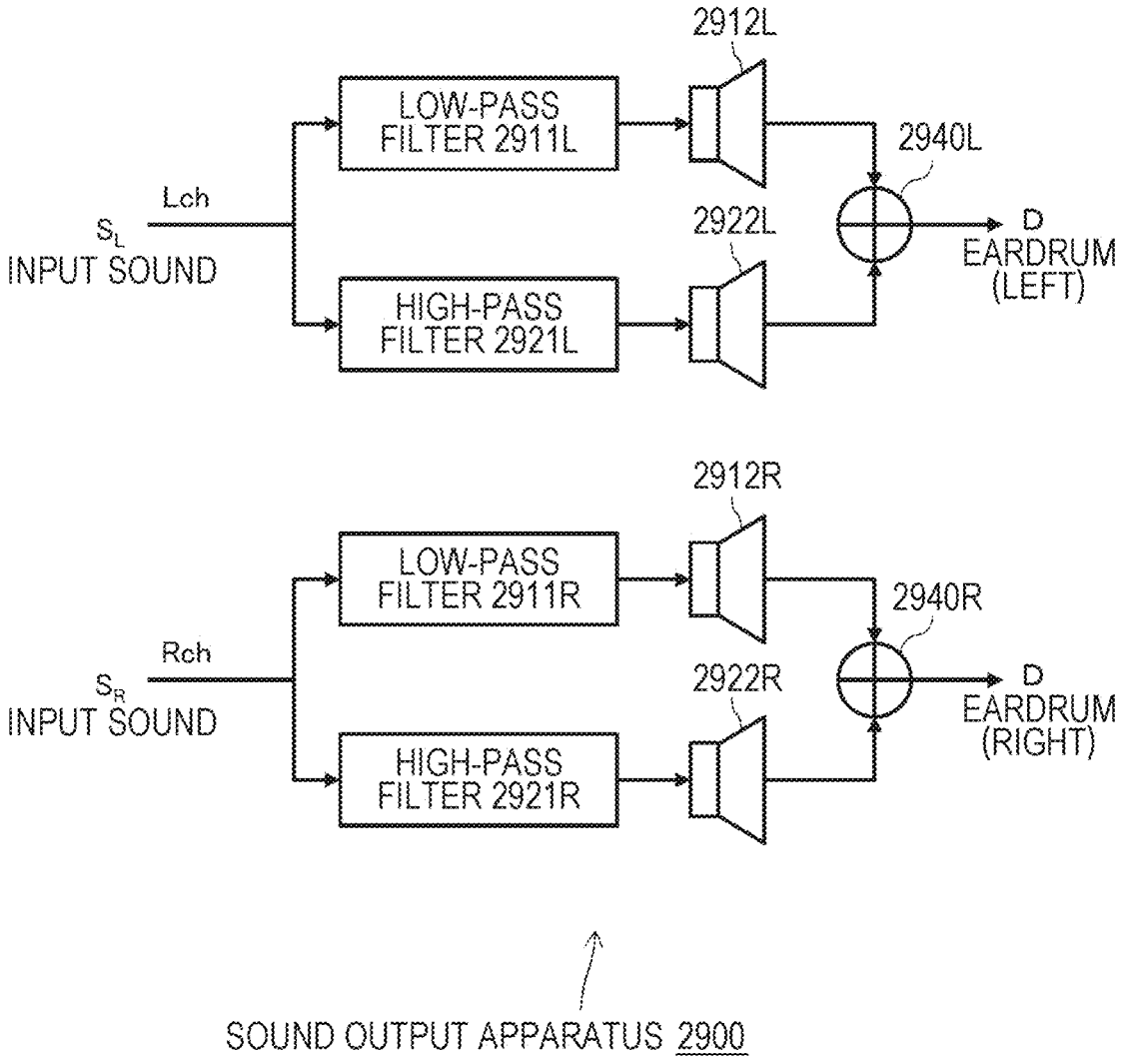
FIG. 29 is a diagram showing a configuration example of a sound output apparatus 2900.

FIG. 29 shows a configuration example of a sound output apparatus 2900 including a means for dividing the frequency bands of the signals inputted into the respective sound generation units. However, the sound output apparatus 2900 includes two sound generation units that are responsible for the respective frequency bands obtained by dividing an input sound into two frequency bands, a low-frequency band and a high-frequency band. Furthermore, this drawing shows the respective processing blocks for audio signals SL and SR inputted for the left ear (Lch) and the right ear (Rch), but the processing blocks have similar configurations so that the left and right blocks are collectively described as one hereinafter.

The audio signal S is inputted into both a low-pass filter 2911 and a high-pass filter 2921. The low-pass filter 2911 and the high-pass filter 2921 are electrically passive elements constituted by combining electrical parts such as a coil, a capacitor, and a resistance element.

The acoustic signal with the low-frequency component, which has passed through the low-pass filter 2911, is inputted into a first sound generation unit 2912. Furthermore, the acoustic signal with the low-frequency component, which has passed through the high-pass filter 2921, is inputted into a second sound generation unit 2922. Therefore, the frequency band of the signal inputted into each of the first sound generation unit 2912 and the second sound generation unit 2922 is divided by the low-pass filter 2911 and the high-pass filter 2921.

The low-frequency sound is generated from the first sound generation unit 2912, and the high-frequency sound is generated from the second sound generation unit 2922. Then, the sounds in the respective frequency bands are joined or synthesized at a joint unit 2940 and then delivered to the eardrum of a listener. Since the frequencies of the input signal are divided by the low-pass filter 2911 and the high-pass filter 2921 in the previous stage, the acoustic signals, in which the components in the frequency bands other than the respective responsible frequency bands are suppressed, are outputted from the first sound generation unit 2912 and the second sound generation unit 2922, and unnatural emphasis in the frequency bands where the mutual reproducible bands overlap can be suppressed.

Note that, in a case where the first sound generation unit 2912 or the second sound generation unit 2922 is less likely to be distorted or damaged even if a signal in the band other than the responsible frequency band is inputted, the low-pass filter 2911 or the high-pass filter 2921 can be omitted as appropriate.

Figure 30:
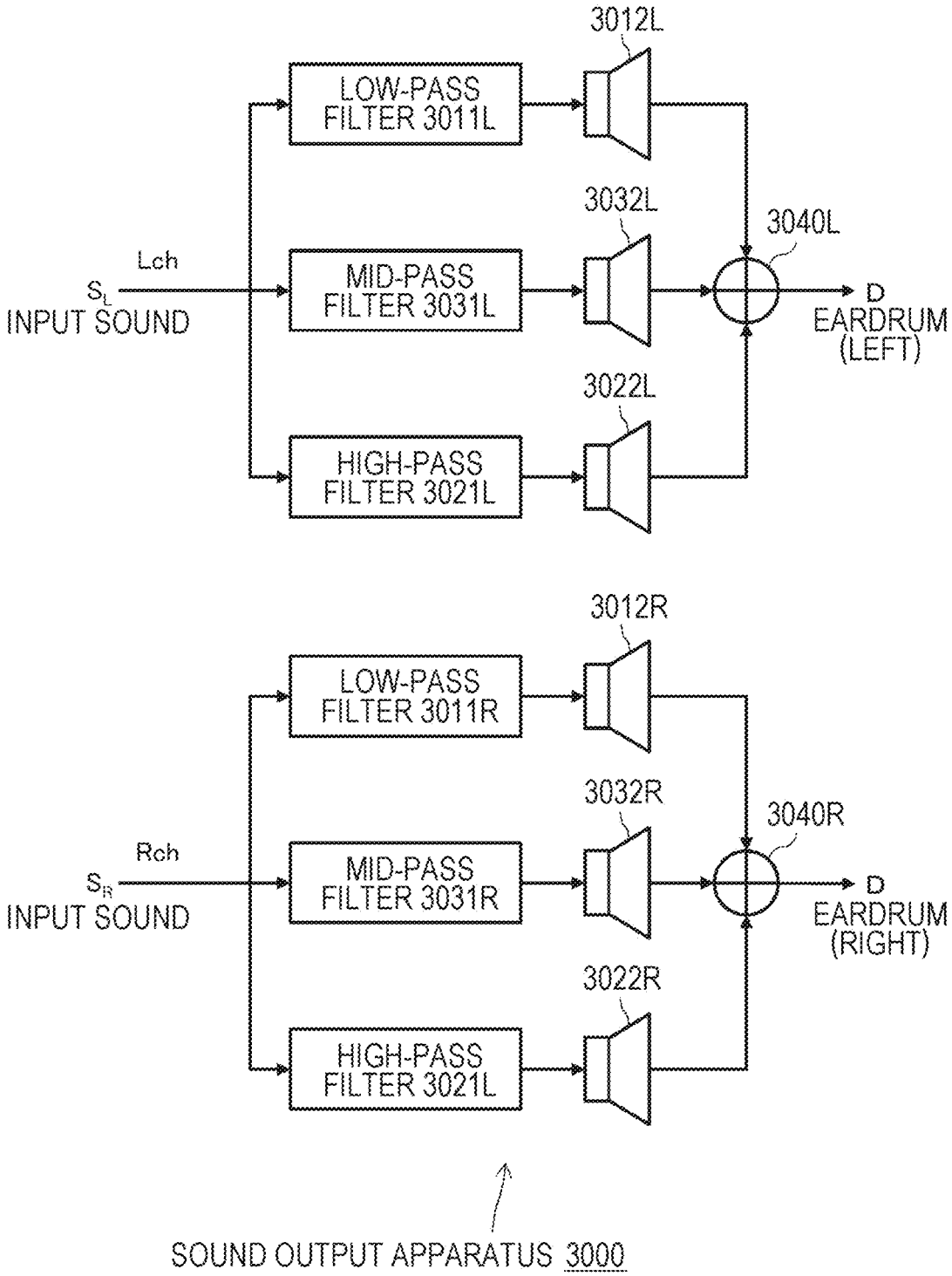
FIG. 30 is a diagram showing a configuration example of a sound output apparatus 3000.

FIG. 30 shows a configuration example of a sound output apparatus 3000 in which input sound is divided into three bands of the low-frequency, mid-frequency, and high-frequency, and three sound generation units are responsible for the respective frequency bands. Furthermore, this drawing shows the respective processing blocks for audio signals SL and SR inputted for the left ear (Lch) and the right ear (Rch), but the processing blocks have similar configurations so that the left and right blocks are collectively described as one hereinafter.

The audio signal S is inputted into all of a low-pass filter 3011, a mid-pass filter 3031, and a high-pass filter 3021. Each of the filters 3011, 3031, and 3021 is an electrically passive element constituted by combining electrical parts such as a coil, a capacitor and a resistance element (the same as above).

The acoustic signals in the respective frequency bands of the low-frequency, mid-frequency, and high-frequency which have passed through the low-pass filter 3011, the mid-pass filter 3013, and the high-pass filter 3021 are inputted into a first sound generation unit 3012, a third sound generation unit 3032, and a second sound generation unit 3022, respectively. That is, the frequency band of the input signal to each of the sound generation units is divided into each of the responsible frequency bands.

The respective sound generation units 3012, 3032, and 3022 generate low-frequency, mid-frequency, and high-frequency sounds, respectively. Then, the sounds in the respective frequency bands are joined or synthesized at a joint unit 3040 and then delivered to the eardrum of a listener. Since the frequencies of the input signal are divided by the respective bandpass filters 3011, 3031, and 3021 in the previous stage, the acoustic signals, in which the components in the frequency bands other than the respective responsible frequency bands are suppressed, are outputted from the respective sound generation units 3012, 3032, and 3022, and the acoustic signals in the respective frequency bands are synthesized at a joint unit 3040 so that unnatural emphasis in the frequency bands where the mutual reproducible bands overlap can be suppressed.

Note that the frequency filters in the previous stage may be omitted as appropriate for the sound generation units that are less likely to be distorted or damaged even if a signal in the bands other than the responsible frequency bands is inputted.

Figure 31:
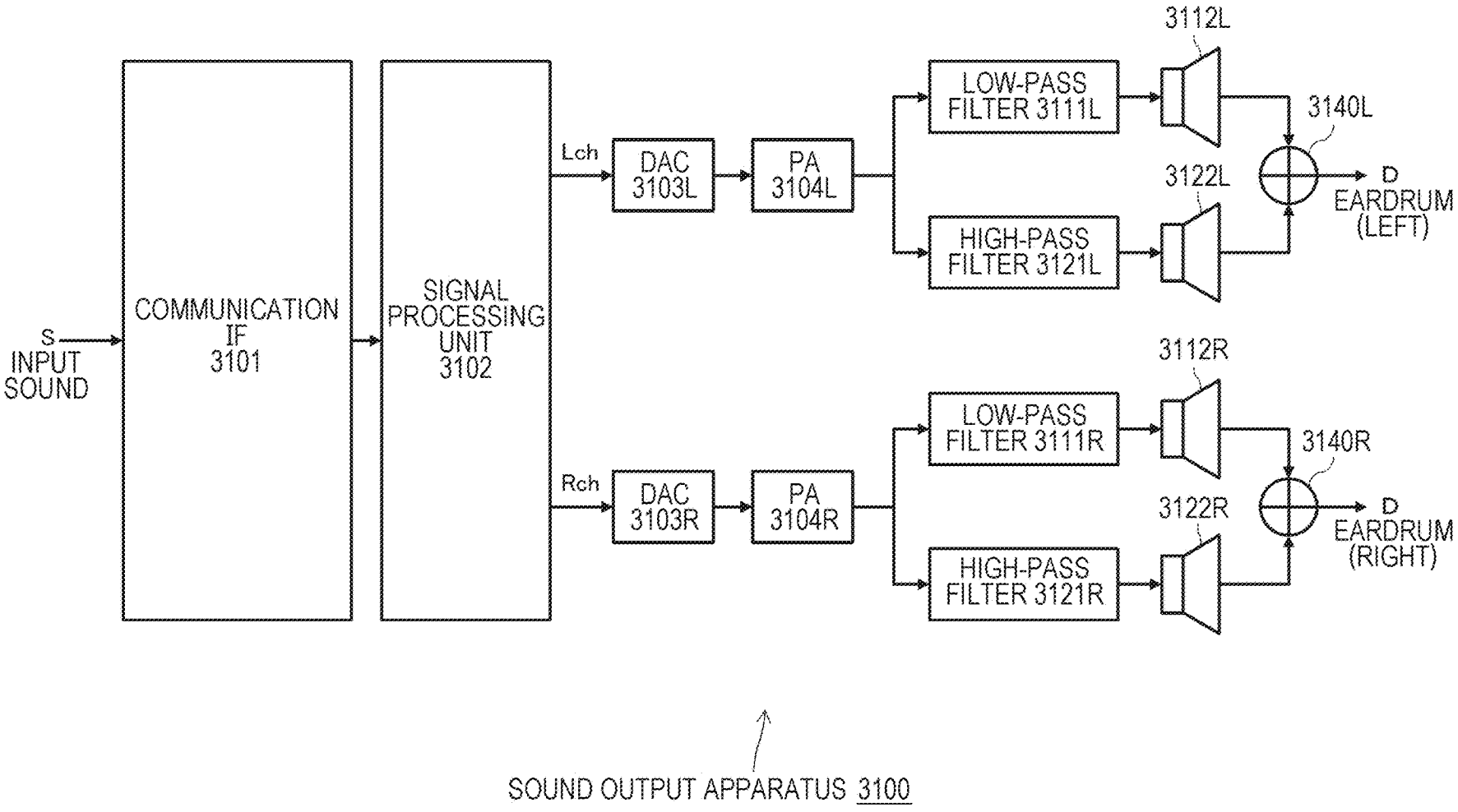
FIG. 31 is a diagram showing a configuration example of a sound output apparatus 3100.

The technology disclosed in this specification can also be applied to a sound output apparatus of a type that sends and receives audio and other digital signals with wire or wirelessly to and from an external apparatus such as a sound source. FIG. 31 shows a configuration example of a sound output apparatus 3100 having a communication function.

A communication interface (IF) 3101 inputs an audio signal S from an external apparatus such as a sound source via a wired or wireless communication path. Furthermore, the communication interface 3101 sends and receives digital signals such as commands besides sound to and from the external apparatus.

A signal processing unit 3102 separates the input audio signal S into audio signals SL and SR for the left ear (Lch) and the right ear (Rch), respectively. This drawing shows the respective processing blocks for the left ear and the right ear after the signal processing unit 3102, but the processing blocks have similar configurations so that the left and right blocks are collectively described as one hereinafter.

The digital audio signal S is converted into an analog signal by a DA converter (DAC) 3103 and further power-amplified by a power amplifier (PA) 3104. Then, the analog audio signal S is inputted into both a low-pass filter 3111 and a high-pass filter 3121. Each of the filters is an electrically passive element constituted by combining electrical parts such as a coil, a capacitor, and a resistance element (the same as above).

The acoustic signals in the respective frequency bands of the low-frequency and high-frequency which have passed through the low-pass filter 3111, and the high-pass filter 3121 are inputted to a first sound generation unit 3112 and a second sound generation unit 3122, respectively. That is, the frequency band of the input signal to each of the sound generation units is divided into each of the responsible frequency bands.

The respective sound generation units 3112 and 3122 generate low-frequency and high-frequency sounds, respectively. Then, the sounds in the respective frequency bands are joined or synthesized at a joint unit 3140 and then delivered to the eardrum of a listener. Since the frequencies of the input signal are divided by the respective bandpass filters 3111 and 3121 in the previous stage, the acoustic signals, in which the components in the frequency bands other than the respective responsible frequency bands are suppressed, are outputted from the respective sound generation units 3112 and 3122 so that unnatural emphasis in the frequency bands where the mutual reproducible frequency bands overlap can be suppressed.

Here, it is also possible to perform signal processing and information presentation depending on the listener's situation recognized or estimated on the basis of sensing information in addition to the command received from the external apparatus by taking in detection signals from sensors such as a GPS and an IMU into the communication interface 3101 and the signal processing unit 3102 (the same as above). The communication interface 3101, the signal processing unit 3102, and the sensors such as a GPS and an IMU are accommodated in, for example, the housing of the first sound generation unit 3112 that can be constituted to be relatively large.

Note that the frequency filters in the previous stage may be omitted as appropriate for the sound generation units that are less likely to be distorted or damaged even if a signal in the bands other than the responsible frequency bands is inputted.

Furthermore, although the illustration and description are omitted, a sound output apparatus can also be similarly configured in which the input sound is divided into three frequency bands of low-frequency, mid-frequency, and high-frequency, and three sound generation units are responsible for the respective frequency bands.

FIGS. 29 to 31 have shown the configuration examples in which the frequency band of the signal inputted into each of the sound generation units is divided at the electric line level or the analog level. On the other hand, the band division can also be performed by digital signal processing.

Figure 32:
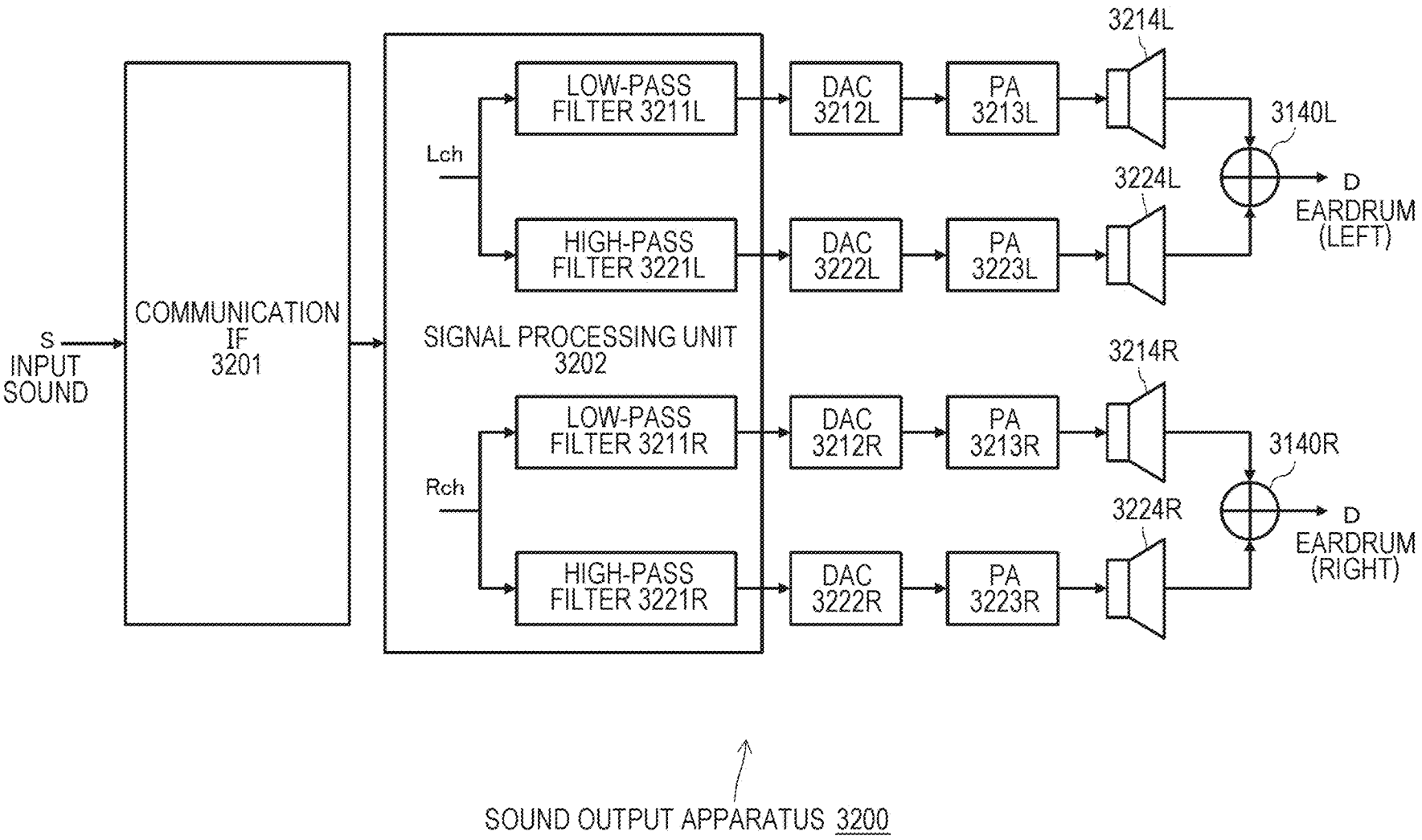
FIG. 32 is a diagram showing a configuration example of a sound output apparatus 3200.

FIG. 32 shows a configuration example of a sound output apparatus 3200 that performs band division by digital signal processing. However, the illustrated sound output apparatus 3200 is equipped with a communication function, like the sound output apparatus 3100 shown in FIG. 31.

A communication interface (IF) 3201 inputs an audio signal S from an external apparatus such as a sound source via a wired or wireless communication path. Furthermore, the communication interface 3201 sends and receives digital signals such as commands besides sound to and from the external apparatus.

A signal processing unit 3202 separates the input audio signal S into audio signals SL and SR for the left ear (Lch) and the right ear (Rch), respectively. This drawing shows the respective processing blocks for the left ear and the right ear after the signal processing unit 3102, but the processing blocks have similar configurations so that the left and right blocks are collectively described as one hereinafter.

The signal processing unit 3202 includes digital filters 3211 and 3221 with different frequency transmission characteristics. One digital filter 3211 is a low-pass filter that transmits a digital audio signal corresponding to a low frequency band, and the other digital filter 3221 is a high-pass filter that transmits a digital audio signal corresponding to a high frequency band.

The low-frequency digital audio signal is converted into an analog signal by a DA converter (DAC) 3212, further power-amplified by a power amplifier (PA) 3213, and then inputted into a first sound generation unit 3214. Furthermore, the high-frequency digital audio signal is converted into an analog signal by a DA converter (DAC) 3222, further power-amplified by a power amplifier (PA) 3223, and then inputted into a second sound generation unit 3224. That is, the frequency band of the input signal to each of the sound generation units is divided into each of the responsible frequency bands.

The respective sound generation units 3214 and 3224 generate low-frequency and high-frequency sounds, respectively. Then, the sounds in the respective frequency bands are joined or synthesized at a joint unit 3240 and then delivered to the eardrum of a listener. Since the frequencies of the input signal are divided by the respective digital filters 3211 and 3221 in the previous stage, the acoustic signals, in which the components in the frequency bands other than the respective responsible frequency bands are suppressed, are outputted from the respective sound generation units 3214 and 3214 so that unnatural emphasis in the frequency bands where the mutual reproducible frequency bands overlap can be suppressed.

Here, it is also possible to perform signal processing and information presentation depending on the listener's situation recognized or estimated on the basis of sensing information in addition to the command received from the external apparatus by taking in detection signals from sensors such as a GPS and an IMU into the communication interface 3201 and the signal processing unit 3202 (the same as above).

Note that the digital filter processing in the previous stage may be omitted as appropriate for the sound generation units that are less likely to be distorted or damaged even if a signal in the bands other than the responsible frequency bands is inputted.

Furthermore, although the illustration and description are omitted, a sound output apparatus can also be similarly configured in which the input sound is divided into three frequency bands of low-frequency, mid-frequency, and high-frequency, and three sound generation units are responsible for the respective frequency bands.

Figure 33:
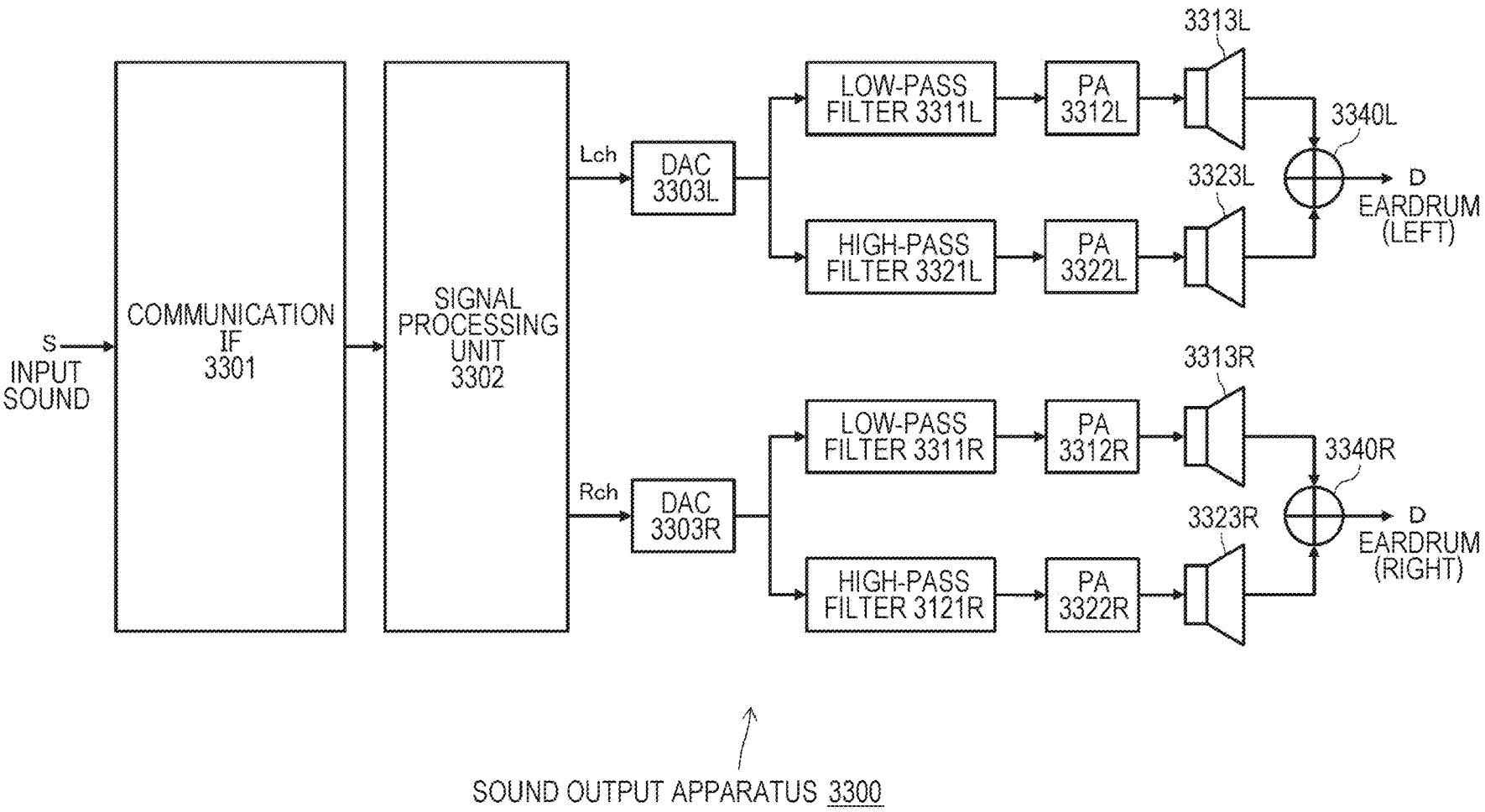
FIG. 33 is a diagram showing a configuration example of a sound output apparatus 3300.

FIG. 33 shows a configuration example of a sound output apparatus 3300 according to a modification example of FIG. 31. Redundant descriptions will be omitted. The constitution is such that an audio signal is converted from a digital signal into an analog signal by a DA converter 3303 and then subjected to band division into a low-frequency band and a high-frequency band by a low-pass filter 3311 and a high-pass filter 3321, each including a passive element and the like. Thus, the number of DA converters can be reduced as compared with the sound output apparatus 3200 shown in FIG. 32. Then, the constitution can also be such that, after the band division in the analog region, signals in the respective frequency bands are amplified by power amplifiers (PA) 3312 and 3322 for low frequency and high frequency, respectively, the low-frequency and high-frequency acoustic signals are outputted from sound generation units 3313 and 3323 for low frequency and high frequency, respectively, and the acoustic signals in the respective frequency bands are synthesized at a joint unit 3340. Furthermore, the low-pass filter 3311 and the high-pass filter 3321 can be constituted by a circuit for band division by an active element using an operational amplifier.

Figure 34:
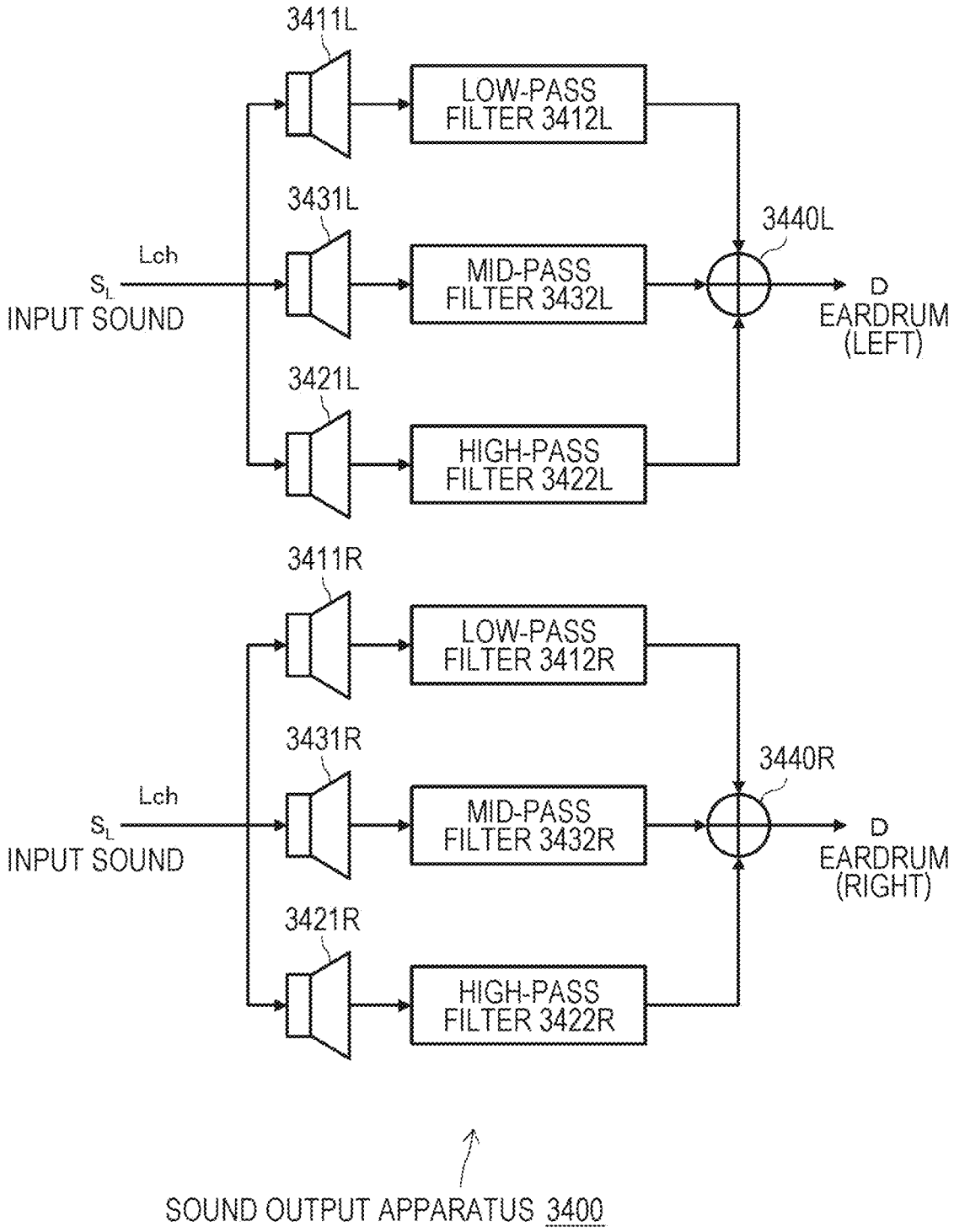
FIG. 34 is a diagram showing a configuration example of a sound output apparatus 3400.

FIG. 34 shows a configuration example of a sound output apparatus 3400 according to another modification example of FIG. 30. Redundant descriptions will be omitted. The sound output apparatus 3000 is constituted such that the bandpass filters each including the electrically passive element (or active element) are used to perform the band division in the previous stage of the sound generation units for the respective frequency bands, and the respective sound generation units generate the sounds in the respective responsible frequency bands. On the other hand, the sound output apparatus 3400 is configured such that analog audio signals, which are power-amplified by a power amplifier (not shown), are uniformly inputted into each of sound generation units 3411, 3421, and 3421 for high-frequency, low-frequency, and mid-frequency bands, respectively, and acoustic signals outputted from the respective sound generation units 3411, 3421, and 3421 are subjected to band division at a low-pass filter 3412, a high-pass filter 3422, and a mid-pass filter 3432, which are arranged at the subsequent stage and each includes an acoustic element, respectively, and then synthesized at a joint unit 3440.

INDUSTRIAL APPLICABILITY

The technology disclosed in this specification has been described above in detail with reference to specific embodiments. However, it is obvious that those skilled in the art can make modifications and substitutions of the embodiments in a scope without departing from the gist of the technology disclosed in this specification.

The sound output apparatus to which the technology disclosed in this specification is applied can obtain a feature of being an ear-hole open type by using a sound guiding unit with a hollow structure to arrange a relatively large sound generation element, which generates a low-frequency sound, at a place away from the ear hole. Furthermore, the sound output apparatus is configured to use a plurality of sound generation units in order to improve high-frequency attenuation and a dip which occur when an acoustic signal is propagated by using the sound guiding unit. Furthermore, the sound output apparatus can suppress the deterioration in sound quality caused by mutual acoustic interference between the sound generation units.

The sound output apparatus to which the technology disclosed in this specification is applied has a feature of being capable of reproducing sound over a wide frequency band. Therefore, this sound output apparatus can be utilized for reproduction output of a sound source such as high-resolution audio.

Furthermore, by taking advantage of the ear-hole open feature, the sound output apparatus can be applied to the fields of various sports (during play, remote coaching and the like) performed outdoors and indoors, such as walking, jogging, cycling, climbing, skiing, and snowboarding, the fields of communication or presentation which requires listening to the ambient sound and presenting the audio information at the same time (e.g., supplementary information at the time of watching a play, audio information presentation in museums, bird watching (cry listening) and the like), driving or navigation, security guards, newscasters, and the like.

In short, the technology disclosed in this specification has been described in the form of exemplification, and the contents of the description in this specification should not be interpreted strictly. To judge the gist of the technology disclosed in this specification, the scope of claims should be taken into consideration.

Note that the technology disclosed in this specification can also adopt the following configurations.

(1) A sound output apparatus including:

a first sound generation unit configured to generate a low-frequency band;

a sound guiding unit with a hollow structure, having one end coupled to the first sound generation unit, and the other end as a sound emission unit including an open end; and a second sound generation unit that is disposed at a place closer to the sound emission unit than the first sound generation unit and generates a high-frequency band.

(1-1) The sound output apparatus according to (1), in which the first sound generation unit is disposed on the back of the ear of a listener.

(1-2) The sound output apparatus according to (1), in which the sound emission unit is worn in the vicinity of the entrance of the ear canal of a listener.

(1-3) The sound output apparatus according to (1), in which the second sound generation unit is disposed in the cavum conchae of a listener.

(1-4) The sound output apparatus according to (1), in which the first sound generation unit or the second sound generation unit has a sounding element including any one of a dynamic type, a balanced armature type, a piezoelectric type, or an electrostatic type, or a combination of two or more types.

(1-5) The sound output apparatus according to (1), in which the length of the sound guiding unit from the sound emission unit to the first sound generation unit is 60 mm to 80 mm, and the length from the sound emission unit to the second sound generation unit is 20 mm or less.

(2) The sound output apparatus according to (1), in which the sound guiding unit has a joint unit that is located before the sound emission unit and takes in a sound from the second sound generation unit.

(2-1) The sound output apparatus according to (1), in which the sound guiding unit includes a first tube configured to propagate an acoustic signal generated from the first sound generation unit, and a second tube configured to propagate an acoustic signal generated from the second sound generation unit.

(3) The sound output apparatus according to (2), in which the sound guiding unit is constituted such that a section from the sound emission unit to the joint unit has a lower impedance than a section from the joint unit to the first sound generation unit.

(4) The sound output apparatus according to any one of (1) to (3), further including a holding unit configured to hold the sound guiding unit in a vicinity of the sound emission unit.

(4-1) The sound output apparatus according to (4), in which the holding unit is inserted into the cavum conchae of a listener and locked to the intertragic notch.

(5) The sound output apparatus according to (4), in which the second sound generation unit is accommodated in the holding unit.

(6) The sound output apparatus according to any one of claims 1 to 5, further including a third sound generation unit configured to generate a mid-frequency band.

(6-1) The sound output apparatus according to (6), in which the third sound generation unit has a sounding element including any one of a dynamic type, a balanced armature type, a piezoelectric type, or an electrostatic type, or a combination of two or more types.

(7) The sound output apparatus according to (6), in which the third sound generation unit is disposed at a place closer to the sound emission unit than the first sound generation unit and farther from the sound emission unit than the second sound generation unit.

(8) The sound output apparatus according to any one of (6) or (7), in which the sound guiding unit has a second joint unit that is located at a place farther from the sound emission unit than a first joint unit configured to take in the sound from the second sound generation unit and takes in a sound from the third sound generation unit.

(9) The sound output apparatus according to any one of (1) to (8), further including a division unit configured to divide a frequency band of a signal inputted into each of the sound generation units in accordance with responsible frequency bands of the respective sound generation units.

(9-1) The sound output apparatus according to (9), in which the division unit includes an electrically passive element loaded on the input sides of the respective sound generation units.

(9-2) The sound output apparatus according to (9), in which the division unit performs frequency band division by digital signal processing.

(9-3) The sound output apparatus according to (9), in which the division unit includes an electrically passive element loaded on the output sides of the respective sound generation units.

(10) The sound output apparatus according any one of (1) to (9), further including:

a communication unit configured to send and receive an audio or another signal to and from an external device; and a signal processing unit configured to process the signal sent and received by the communication unit.

(10-1) The sound output apparatus according to (10), in which at least one of the communication unit or the signal processing unit is accommodated in a housing of the first sound generation unit.

(11) The sound output apparatus according to any one of (1) to (10), further including a GPS, an IMU, or another sensor.

(11-1) The sound output apparatus according to (11), in which the sensor is accommodated in the housing of the first sound generation unit.

(11-2) The sound output apparatus according to (11), further including a processing unit configured to perform signal processing or information presentation on the basis of sensing information from the sensor.

REFERENCE SIGNS LIST

100 Sound output apparatus
101 First sound generation unit
102 Second sound generation unit
103 Sound guiding unit
104 Sound emission unit
105 Joint unit
1300 Sound output apparatus
1301 Holding unit
1500 Sound output apparatus
1501 Holding unit
1800 Sound output apparatus
1801 Holding unit
1802 Second sound generation unit
2100 Sound generation apparatus
2101 First sound generation unit
2102 Second sound generation unit
2103 Third sound generation unit
2104 Sound guiding unit
2105 Sound emission unit
2111 First joint unit
2112 Second joint unit
2400 Sound output apparatus
2401 First sound generation unit
2402 Second sound generation unit
2403 Third sound generation unit
2404 Sound guiding unit
2405 Sound emission unit
2411 First joint unit
2412 Second joint unit
2900 Sound output apparatus
2911 Low-pass filter
2912 First sound generation unit
2921 High-pass filter
2922 Second sound generation unit
2940 Joint unit
3000 Sound output apparatus
3011 Low-pass filter
3012 First sound generation unit
3021 High-pass filter
3022 Second sound generation unit
3031 Mid-pass filter
3032 Third sound generation unit
3040 Joint unit
3100 Sound output apparatus
3101 Communication interface
3102 Signal processing unit
3103 DA converter
3104 Power amplifier
3111 Low-pass filter
3112 First sound generation unit
3121 High-pass filter
3122 Second sound generation unit
3140 Joint unit
3200 Sound output apparatus
3201 Communication interface
3202 Signal processing unit
3211 Digital filter (low frequency)
3212 DA converter
3213 Power amplifier
3214 First sound generation unit
3211 Digital filter (low frequency)
3212 DA converter
3213 Power amplifier
3214 First sound generation unit
3221 Digital filter (high frequency)
3222 DA converter
3223 Power amplifier
3224 Second sound generation unit
3240 Joint unit

The invention claimed is:

1. A sound output apparatus comprising:

a first sound generation unit configured to generate a low-frequency band;

a first sound guiding unit with a hollow structure, having one end coupled to the first sound generation unit, and another end as a sound emission unit including an open end;

a second sound generation unit that is disposed at a place closer to the sound emission unit than the first sound generation unit and generates a high-frequency band, wherein the first sound guiding unit includes a substantially U-shaped portion configured to be hooked onto the ear of a listener; and a holding unit configured to hold the first sound guiding unit in a vicinity of the sound emission unit, wherein the holding unit is configured to have a peripheral structure that defines a through opening, the through opening realizing listening characteristics of the ambient sound in a wearing state that are equivalent to those in a non-wearing state, wherein the sound emission unit, the second sound generation unit and a second sound guiding unit are disposed in the peripheral structure of the holding unit, and wherein the second sound guiding unit joins the first sound guiding unit in the peripheral structure of the holding unit.

2. The sound output apparatus according to claim 1, wherein the first sound guiding unit has a joint unit that is located before the sound emission unit and takes in a sound from the second sound generation unit.

3. The sound output apparatus according to claim 2, wherein the first sound guiding unit is constituted such that a section from the sound emission unit to the joint unit has a lower impedance than a section from the joint unit to the first sound generation unit.

4. The sound output apparatus according to claim 1, further comprising a third sound generation unit configured to generate a mid-frequency band.

5. The sound output apparatus according to claim 4, wherein the third sound generation unit is disposed at a place closer to the sound emission unit than the first sound generation unit and farther from the sound emission unit than the second sound generation unit.

6. The sound output apparatus according to claim 4, wherein the first sound guiding unit has a second joint unit that is located at a place farther from the sound emission unit than a first joint unit configured to take in a sound from the second sound generation unit and takes in a sound from the third sound generation unit.

7. The sound output apparatus according to claim 1, further comprising a division unit configured to divide a frequency band of a signal inputted into each of the sound generation units in accordance with responsible frequency bands of the respective sound generation units.

8. The sound output apparatus according to claim 1, further comprising:

a communication unit configured to send and receive an audio or another signal to and from an external device; and a signal processing unit configured to process the signal sent and received by the communication unit.

9. The sound output apparatus according to claim 1, further comprising a GPS, an IMU, or another sensor.

10. The sound output apparatus according to claim 1, wherein the first sound guiding unit further includes a sound emission portion disposed at a substantially right angle to a plane of the U-shaped portion.

11. The sound output apparatus according to claim 1, wherein the peripheral structure is one of annular shape or a shape that is compatible with the shape of the listener's ear.

* * * * *